US007907103B2

(12) United States Patent
Jung et al.

(10) Patent No.: US 7,907,103 B2
(45) Date of Patent: Mar. 15, 2011

(54) PLASMA DISPLAY APPARATUS AND DRIVING METHOD THEREOF

(75) Inventors: Yunkwon Jung, Gumi-si (KR); Muk Hee Kim, Buk-gu Daegu (KR); Byung Hyun Kim, Gumi-si (KR); Myung Soo Ham, Pusan (KR)

(73) Assignee: LG Electronics Inc., Seoul (KR)

( * ) Notice: Subject to any disclaimer, the term of this patent is extended or adjusted under 35 U.S.C. 154(b) by 1136 days.

(21) Appl. No.: 11/349,278

(22) Filed: Feb. 8, 2006

(65) Prior Publication Data

US 2006/0279479 A1 Dec. 14, 2006

(30) Foreign Application Priority Data

Jun. 13, 2005 (KR) ..... 10-2005-0050645

(51) Int. Cl.
*G09G 3/28* (2006.01)

(52) U.S. Cl. ..... 345/63; 345/60; 345/72

(58) Field of Classification Search ..... 345/60–72
See application file for complete search history.

(56) References Cited

U.S. PATENT DOCUMENTS

| | | | | |
|---|---|---|---|---|
| 6,388,678 | B1 | 5/2002 | Kasahara et al. | |
| 6,396,508 | B1 | 5/2002 | Noecker | |
| 6,621,229 | B2 * | 9/2003 | Kanazawa et al. | 315/169.3 |
| 6,670,774 | B2 * | 12/2003 | Son et al. | 315/169.4 |
| 6,791,516 | B2 | 9/2004 | Kang | |
| 6,954,188 | B2 * | 10/2005 | Seo et al. | 345/66 |
| 2002/0014847 | A1 | 2/2002 | Nagakubo et al. | 315/169.1 |
| 2002/0053883 | A1 | 5/2002 | Choi | |
| 2002/0084953 | A1 | 7/2002 | Yoon et al. | |
| 2002/0097003 | A1 * | 7/2002 | Takamori et al. | 315/169.4 |
| 2002/0195970 | A1 | 12/2002 | Lim et al. | 315/169.4 |
| 2003/0080926 | A1 * | 5/2003 | Morimoto | 345/60 |
| 2003/0234753 | A1 | 12/2003 | Tanaka | 345/67 |
| 2004/0130508 | A1 * | 7/2004 | Mizobata | 345/60 |
| 2004/0239588 | A1 | 12/2004 | Nagao et al. | 345/60 |
| 2005/0073485 | A1 | 4/2005 | Kim et al. | 345/63 |
| 2005/0088374 | A1 | 4/2005 | Kim et al. | 345/60 |

(Continued)

FOREIGN PATENT DOCUMENTS

CN 1773579 A 5/2006

(Continued)

OTHER PUBLICATIONS

European Search Report dated Nov. 13, 2008.

(Continued)

*Primary Examiner* — Alexander Eisen
*Assistant Examiner* — Nelson Lam
(74) *Attorney, Agent, or Firm* — KED & Associates, LLP

(57) ABSTRACT

A plasma display apparatus and a driving method of a plasma display panel are provided. This may include a plasma display panel having a plurality of scan electrodes and sustain electrodes, and a plurality of address electrodes formed to intersect with the plurality of scan electrodes and sustain electrodes. A driving unit/circuit may drive the scan electrodes, the sustain electrodes, and the address electrodes to allow a voltage difference between the scan electrode and the sustain electrode or a voltage difference between the scan electrode and the address electrode during an address period at one or more subfields of a frame to be larger than a voltage difference between the scan electrode and the sustain electrode or a voltage difference between the scan electrode and the address electrode during the address period at other subfields.

41 Claims, 27 Drawing Sheets

U.S. PATENT DOCUMENTS

| | | | | |
|---|---|---|---|---|
| 2005/0110713 | A1 | 5/2005 | Chung et al. | 345/60 |
| 2005/0259042 | A1* | 11/2005 | Lee | 345/63 |

FOREIGN PATENT DOCUMENTS

| | | | |
|---|---|---|---|
| EP | 0 903 719 | B1 | 3/1999 |
| EP | 1 434 192 | A2 | 6/2004 |
| EP | 1 538 590 | A2 | 6/2005 |
| JP | 08-146914 | | 6/1996 |
| JP | 11-065517 | | 3/1999 |
| KR | 10 2000 003392 | | 1/2000 |
| KR | 10 2004 0000327 | | 1/2004 |
| KR | 10-2004-0006571 | A | 1/2004 |
| KR | 10 2005 0051537 | | 6/2005 |
| TW | 440884 | | 6/2001 |
| TW | 511054 | | 11/2002 |

OTHER PUBLICATIONS

Taiwanese Office Action dated Oct. 27, 2009 and English language translation.

Chinese Office Action dated Apr. 11, 2008 and English language translation.

* cited by examiner

Fig. 4

| | SF1 (1) | SF2 (2) | SF3 (4) | SF4 (8) | SF5 (16) | SF6 (32) | SF7 (64) | SF8 (128) |
|---|---|---|---|---|---|---|---|---|
| 0 | X | X | X | X | X | X | X | X |
| 1 | 0 | X | X | X | X | X | X | X |
| 2 | X | 0 | X | X | X | X | X | X |
| 3 | 0 | 0 | X | X | X | X | X | X |
| 4 | X | X | 0 | X | X | X | X | X |
| ⋮ | ⋮ | ⋮ | ⋮ | ⋮ | ⋮ | ⋮ | ⋮ | ⋮ |
| 126 | X | 0 | 0 | 0 | 0 | 0 | 0 | X |
| 127 | 0 | 0 | 0 | 0 | 0 | 0 | 0 | X |
| 128 | X | X | X | X | X | X | X | 0 |
| ⋮ | ⋮ | ⋮ | ⋮ | ⋮ | ⋮ | ⋮ | ⋮ | ⋮ |
| 252 | X | X | 0 | 0 | 0 | 0 | 0 | 0 |
| 253 | 0 | X | 0 | 0 | 0 | 0 | 0 | 0 |
| 254 | X | 0 | 0 | 0 | 0 | 0 | 0 | 0 |
| 255 | 0 | 0 | 0 | 0 | 0 | 0 | 0 | 0 |

PLASMA DISPLAY APPARATUS AND DRIVING METHOD THEREOF

This nonprovisional application claims priority under 35 U.S.C. §119(a) from Patent Application No. 10-2005-0050645 filed in Korea on Jun. 13, 2005 the entire contents of which are hereby incorporated by reference.

BACKGROUND OF THE INVENTION

1. Field of the Invention

Embodiments of the present invention relate to a plasma display panel. More particularly, embodiments of the present invention may relate to a plasma display apparatus and a driving method thereof, wherein a frame includes at least one subfield that does not include a sustain period or is not supplied with a sustain pulse in a sustain period thereof. A voltage difference between a sustain electrode Z and a scan electrode Y or between a scan electrode Y and an address electrode Z in the subfield is greater than a voltage difference of the other subfields, thereby increasing gray level representation capability and reducing halftone noise.

2. Background of Related Art

In a plasma display panel, a unit cell may be defined by barrier ribs disposed between a front substrate and a rear substrate. Each cell may be filled with a main discharge gas such as neon (Ne), helium (He) and a gas mixture of Ne and He, and an inert gas containing a small amount of xenon (Xe). When the gas is discharged due to a high frequency voltage, the inert gas may generate vacuum ultra-violet rays, and fluorescent material existing between the barrier ribs may be radiated due to the vacuum ultra-violet rays, thereby displaying an image. Since the plasma display panel can be implemented in a thin and light structure, it has been in the limelight as the next generation display apparatus.

SUMMARY OF THE INVENTION

Embodiments of the present invention may provide a plasma display apparatus and a driving method thereof. Image quality degradation may be prevented by controlling a voltage difference between a sustain electrode Z and a scan electrode Y or by controlling a voltage difference between a scan electrode Y and an address electrode X, and by supplying no sustain pulse (or signal or waveform) in a sustain period in a low gray level subfield or by setting up no sustain period in the low gray level subfield for representing the lowest gray level.

A plasma display apparatus according to an example embodiment of the present invention may include a plasma display panel having a plurality of scan electrodes, a plurality of sustain electrodes, and a plurality of address electrodes arranged to intersect the scan electrodes and the sustain electrode. A driving part for driving the scan electrodes, the sustain electrodes and the address electrodes may also be provided. Further, a driving pulse controlling part may control the driving part so that a voltage difference between the scan electrode and the sustain electrode or a voltage difference between the scan electrode and the address electrode in an address period of at least one subfield of a frame is greater than that of the other subfields of the frame.

A voltage difference between the scan electrode and the sustain electrode or a voltage difference between the scan electrode and the address electrode in an address period of at least one subfield of a frame may be greater than that of the other subfields of the frame.

Embodiments of the present invention may increase gray level representation capability and reduce halftone noise by providing a subfield capable of representing gray levels of decimal numbers, wherein the subfield does not include a sustain period, or is not supplied with a scan pulse (or signal or waveform) in a sustain period thereof, and a voltage difference between the scan electrode Y and the sustain electrode Z or a voltage difference between the scan electrode Y and the address electrode X in the subfield is set to be greater than that in other subfields.

Other objects, advantages and salient features of the invention will become more apparent from the following detailed description taken in conjunction with the annexed drawings which disclose embodiments of the invention.

BRIEF DESCRIPTION OF THE DRAWINGS

The invention will be described in detail with reference to the following drawings in which like reference numerals refer to like elements wherein:

FIG. 4 is a graph representing gray levels of an image in accordance with an image gray level representation method shown in FIG. 3;

DETAILED DESCRIPTION OF PREFERRED EMBODIMENTS

Arrangements and embodiments of the present invention will be described in a more detailed manner with reference to the drawings.

Figure 1:
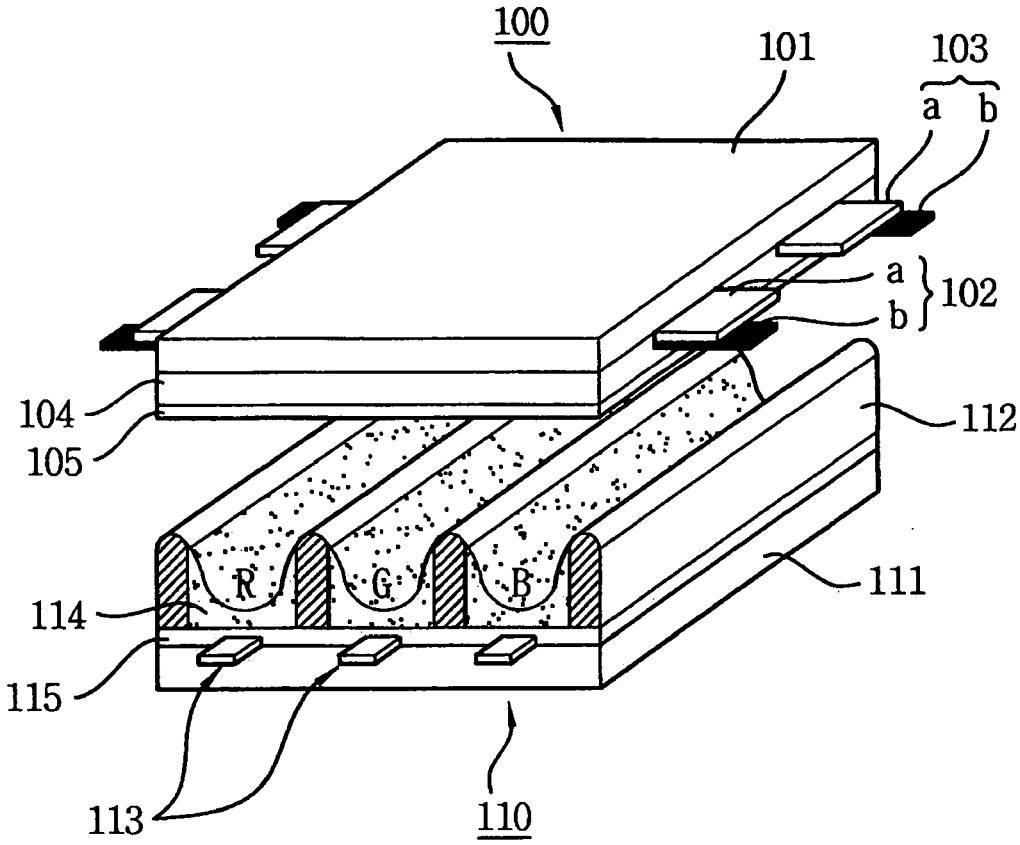
FIG. 1 illustrates a schematic view illustrating a structure of a plasma display panel according to an example arrangement.

FIG. 1 illustrates a schematic view showing a structure of a plasma display panel according to an example arrangement. Other arrangements are also possible.

As shown, a plasma display panel includes a front panel 100 and a rear panel 110 disposed apart from each other by a distance and combined with each other. The front panel 100 includes a front glass 101 serving as a displaying surface, and scan electrodes 102 and sustain electrodes 103 arranged in sustain pairs on the front glass 101. The rear panel 110 includes a rear glass 111 providing a rear surface of the plasma display apparatus and address electrodes 113 arranged on the rear glass 111 to intersect the sustain electrode pairs.

The front panel 100 includes a plurality of pairs of sustain electrodes, in which each pair includes a scan electrode 102 and a sustain electrode 103 for discharging mutually and sustaining radiation in a cell and in which each of the scan electrodes 102 and sustain electrodes 103 includes a transparent electrode "a" made of transparent indium tin oxide (ITO) material and a bus electrode "b" made of a metal. The scan electrodes and the sustain electrodes included in the front panel 100 constitutes a pair. The scan electrodes 102 and the sustain electrodes 103 are coated with one or more upper dielectric layers 104 that limit a discharge current and insulate each pair of electrodes from other pairs. Further, a protection layer 105 made of magnesium oxide MgO is formed on the top surface of the upper dielectric layer 104 to ease a discharge condition.

On the rear panel 110, stripe type (or well type) barrier ribs 112 may be arranged in parallel with each other to form a plurality of discharge spaces (i.e., discharge cells). Further, a plurality of address electrodes 113 for generating vacuum ultraviolet rays by address discharge may be arranged in parallel with the barrier ribs 112. Still further, R, G, B fluorescent substances 114 for emitting visible light rays, which display an image, in an address discharge are coated over the upper surface of the rear panel 110. A lower dielectric layer 115 is provided between the address electrodes 113 and the fluorescent substances 114 to protect the address electrodes 113.

Figure 2:
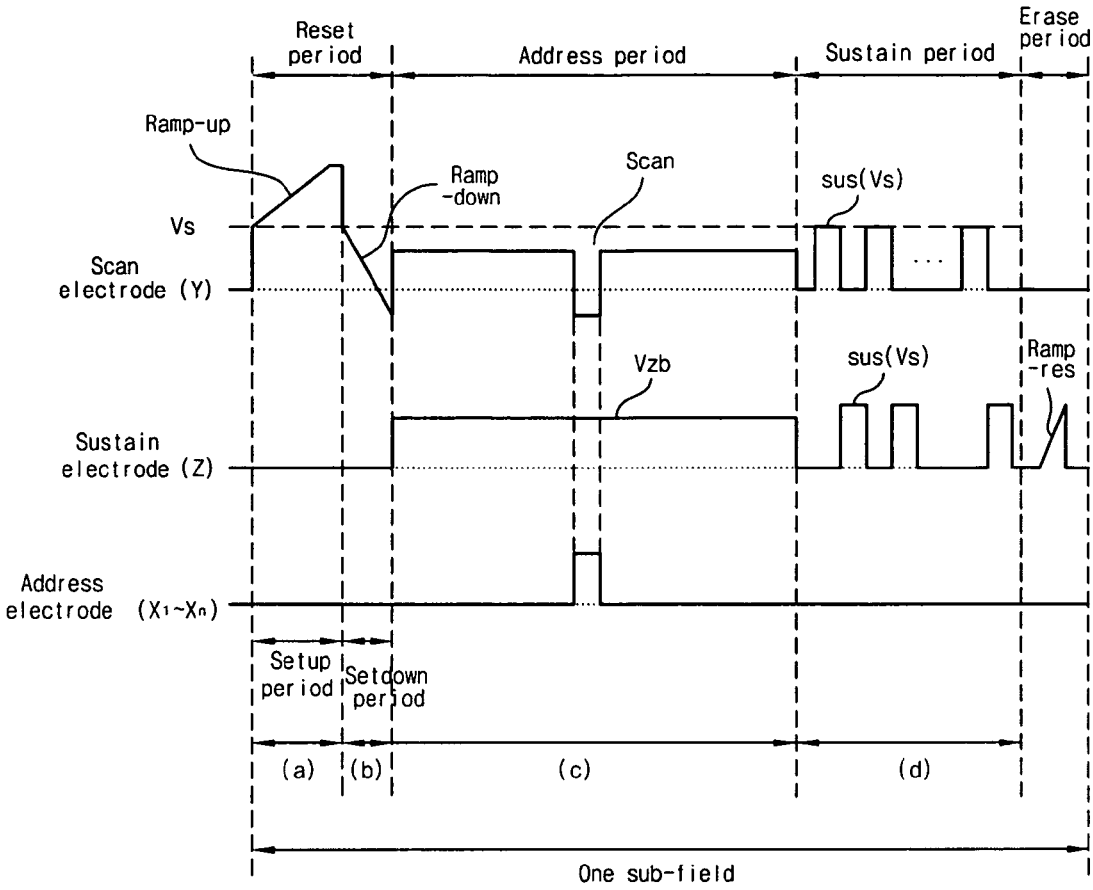
FIG. 2 illustrates a driving waveform of a plasma display panel according to an example arrangement.

A driving waveform in accordance with a driving method of a plasma display panel is shown in FIG. 2.

FIG. 2 illustrates a driving waveform of a plasma display panel according to an example arrangement. Other arrangements are also possible.

As shown in FIG. 2, the plasma display panel may be driven with a plurality of periods, such as a reset period for initializing all the cells, an address period for selecting cells to be discharged, a sustain period for sustaining discharge in the selected cells and an erasing period for erasing wall charges in the discharged cells.

In a set-up period of the reset period, a ramp-up waveform may be simultaneously applied to all scan electrodes, so that weak dark discharge occurs in all the scan electrodes due to the ramp-up waveform. Due to the set-up discharge, positive wall charges are accumulated over the address electrodes and the sustain electrodes, and negative wall charges may be accumulated over the scan electrodes.

In a set-down period of the reset period, a ramp-down waveform may cause a weak erasing discharge in the cells after the ramp-up waveform is applied. The ramp-down waveform may fall (or decrease) from a positive voltage lower than a peak voltage of the ramp-up waveform to a predetermined voltage lower than a ground voltage. The ramp-down waveform may sufficiently erase the wall charges excessively generated over the scan electrodes. As a result, the wall charges remain uniformly in the cells to cause the address discharge stably due to the set-down discharge.

In the address period, a negative scan pulse (or signal or waveform) may be sequentially applied to the scan electrodes, and simultaneously a positive data pulse (or signal or waveform) synchronized with the negative scan pulse may be applied to the address electrodes. As the voltage difference between the scan pulse and the data pulse and the voltage of the wall charges generated during the reset-period are added, an address discharge is caused within the discharge cells to which the data pulse is applied. Wall charges remain within the cells selected due to the address discharge to a degree by which discharge can be caused when a sustain voltage Vs is applied. The sustain electrode is supplied with a positive voltage Vz so that the sustain electrode does not cause a wrong discharge with the scan electrode by reducing a voltage difference with the scan electrode during the set-down and the address periods.

In the sustain period, the scan electrodes and the sustain electrodes are alternately applied with a sustain pulse sus (or signal or waveform). As the voltage of the wall charge within the cell and the sustain pulse sus are added in the cell selected due to the address discharge, the sustain discharge (i.e., display discharge) occurs between the scan electrode and the sustain electrode even when the sustain pulse is applied.

After the sustain discharge is completed, an erasing ramp-ers waveform having a small pulse width and a low voltage level may be applied to the sustain electrode so that wall charges remaining within the cells constituting the whole picture are erased.

Figure 3:
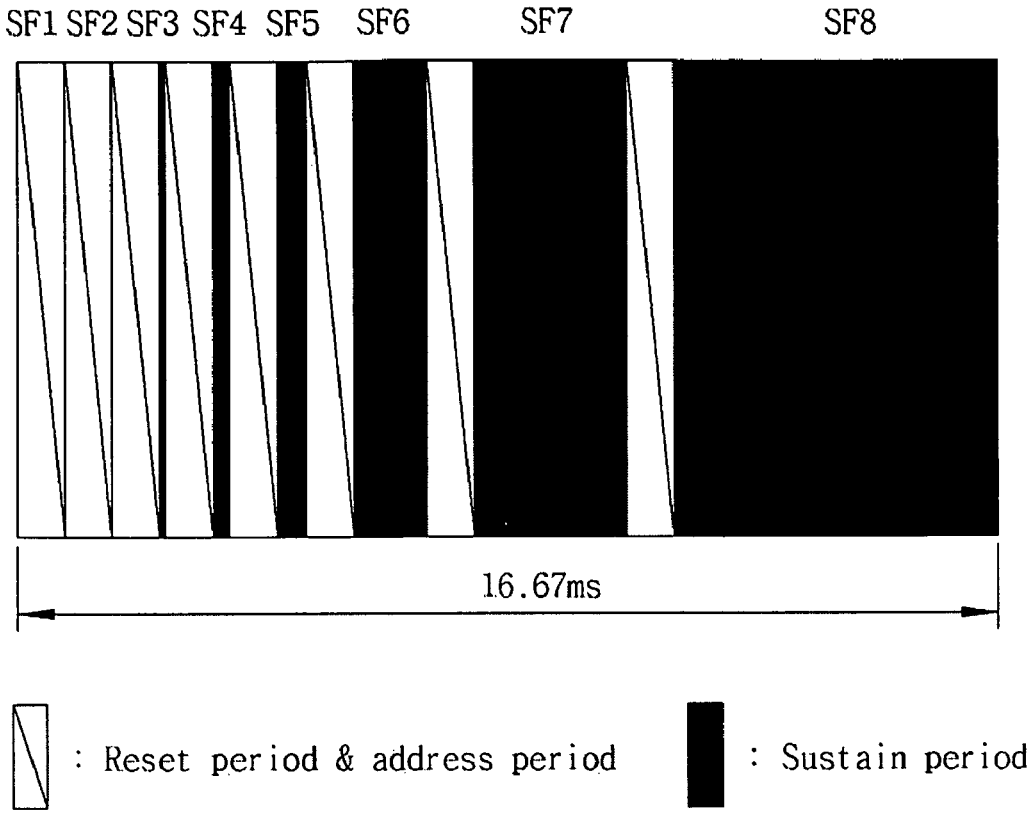
FIG. 3 illustrates a method of representing gray levels in a plasma display panel according to an example arrangement.

A method of representing gray levels of an image on a plasma display panel being driven by such a waveform is shown in FIG. 3.

FIG. 3 illustrates a method of representing image gray levels in a plasma display panel according to an example arrangement. Other arrangements are also possible.

As shown in FIG. 3, in a method of representing gray levels in a plasma display panel, one frame period may be divided into a plurality of subfields having different discharge frequencies, and each subfield may be further divided into a reset period RPD for initializing all cells, an address period APD for selecting cells to be discharged and a sustain period DPD for representing gray levels according to a number of discharges. For example, in case of representing an image with 256 gray levels, a frame period (16.67 ms) corresponding to 1/60 second may be divided into eight subfields SF1 to SF8 as shown in FIG. 3. Each of the subfields SF1 to SF8 may be further divided into a reset period, an address period and a sustain period.

The reset periods and the address periods may be identical to each other for each subfield. An address discharge may be caused by a voltage difference between an address electrode and a transparent electrode serving as a scan electrode. The sustain period increases in each subfield at the rate of 2n (n=0, 1, 2, 3, 4, 5, 6, 7). Since the sustain periods in the subfields differ from each other as described above, a gray level of an image can be embodied by changing the sustain periods of the subfields (i.e., by changing the number of sustain discharges).

An example of representing gray levels of an image is shown in FIG. 4. More specifically, FIG. 4 is a graph representing gray levels of an image in accordance with an image gray level representation method shown in FIG. 3.

In the method of representing an image gray level shown in FIG. 3, all subfields for representing gray level 0 are not selected as shown in FIG. 4. For example, the first to the eighth subfield are not selected. That is, a data pulse is not applied during a period between the first to eighth subfields. Here, the first subfield that has the lowest gray level weight is selected to represent gray level 1. That is, a data pulse (or signal or waveform) is applied in the first subfield. In such a manner, the data pulse is supplied in the second subfield and the third subfield to represent gray level 2 and gray level 3. Additionally, the data pulse is supplied in all the subfields (i.e., the first subfield to the eighth subfield) to represent 255 gray levels. Here, O represents that a data pulse is supplied in the corresponding subfield and X represents that a data pulse is not supplied.

In such a method of representing image gray levels, the representable gray levels are determined with an integer. That is, the representable gray levels are 1, 2, 3, etc. Accordingly, a halftone correction method such as error diffusion or dithering may be used to represent a gray level between level 0 and level 1 (i.e., a gray level of a decimal number). However, such a method may be disadvantageous in that a complicated program may be needed to implement the method, and noise may be generated upon the halftone correction by the error diffusion or the dithering method so that image quality is degraded. Such image degradation is remarkably shown in case that the reproduced image has a relative low gray level.

Accordingly, a method of controlling a number of sustain pulses (or signals or waveforms) supplied in a sustain period may be used to simplify the halftone correction process such as error diffusion, dithering and so on, as described above.

Figure 5:
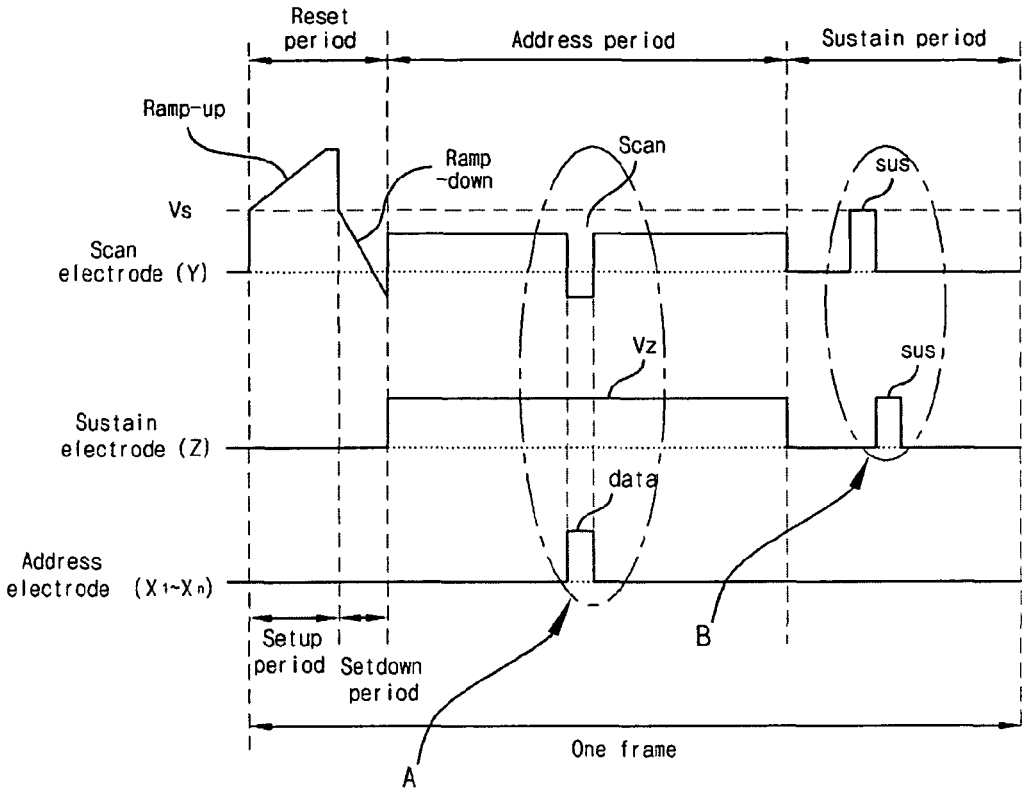
FIG. 5 illustrates a driving waveform for explaining a method of controlling a number of sustain pulses applied in a sustain period to improve image quality in low gray level according to an example arrangement.

Such a method of controlling the number of pulses applied in the sustain period to improve image quality with low gray level is shown in FIG. 5.

FIG. 5 illustrates a driving waveform for explaining a method of controlling a number of sustain pulses (or signals or waveforms) applied in a sustain period to improve image quality with low gray level according to an example arrangement. Other arrangements are also possible.

As shown in FIG. 5, the number of the sustain pulses applied in the sustain period to improve image quality with low gray level may be controlled to be a minimum number. For example, the sustain pulse applied to the scan electrode Y is set up to be 1 and also the sustain pulse applied to the sustain electrode Z is 1. That is, the lowest gray level subfield capable of representing the lowest gray level (i.e., a gray level of a decimal number) may be set up by setting the number of the sustain pulses applied in the sustain period as a smallest number so that gray level representation becomes more delicate.

In such a case, the discharge capable of affecting the gray level representation is an address discharge caused in an address period and a sustain discharge caused in a sustain period. Light rays emitted by such discharges are diffused, thereby representing a gray level. That is, in the driving waveform shown in FIG. 5 described above, the gray level may be determined by the lights generated due to the address discharge and the sustain discharge. Discharges affecting the gray level are shown in FIG. 6.

Figure 6:
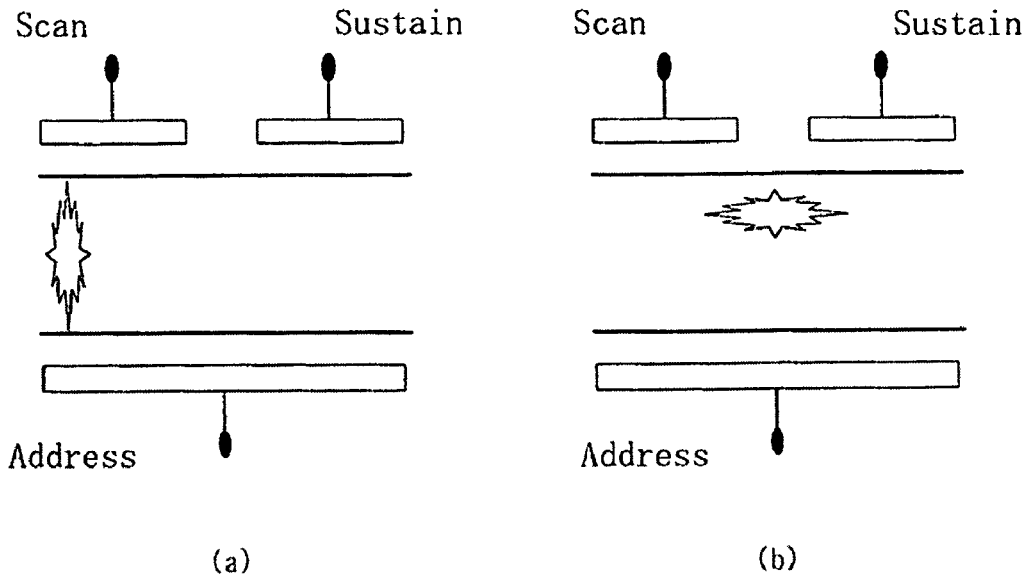
FIG. 6 illustrates an example arrangement of discharges affecting the representation of gray levels when using the driving waveform shown in FIG. 5.

FIG. 6 illustrates an example arrangement of discharges affecting the representation of gray levels when using the driving waveform shown in FIG. 5. Other arrangements are also possible.

Referring to FIG. 6, in a portion A of the driving waveform in FIG. 5, an address discharge is caused between the scan electrode Y and the address electrode X in the address period. On the other hand, in a portion B of the driving waveform in FIG. 5, a sustain discharge is caused between the scan electrode Y and the sustain electrode Z in the sustain period. According to the driving waveform in FIG. 5, even though the reset discharge is caused in a reset period, since the reset discharge is caused in all the cells on the plasma display panel, lights produced by the reset discharge do not affect gray level.

Figure 7:
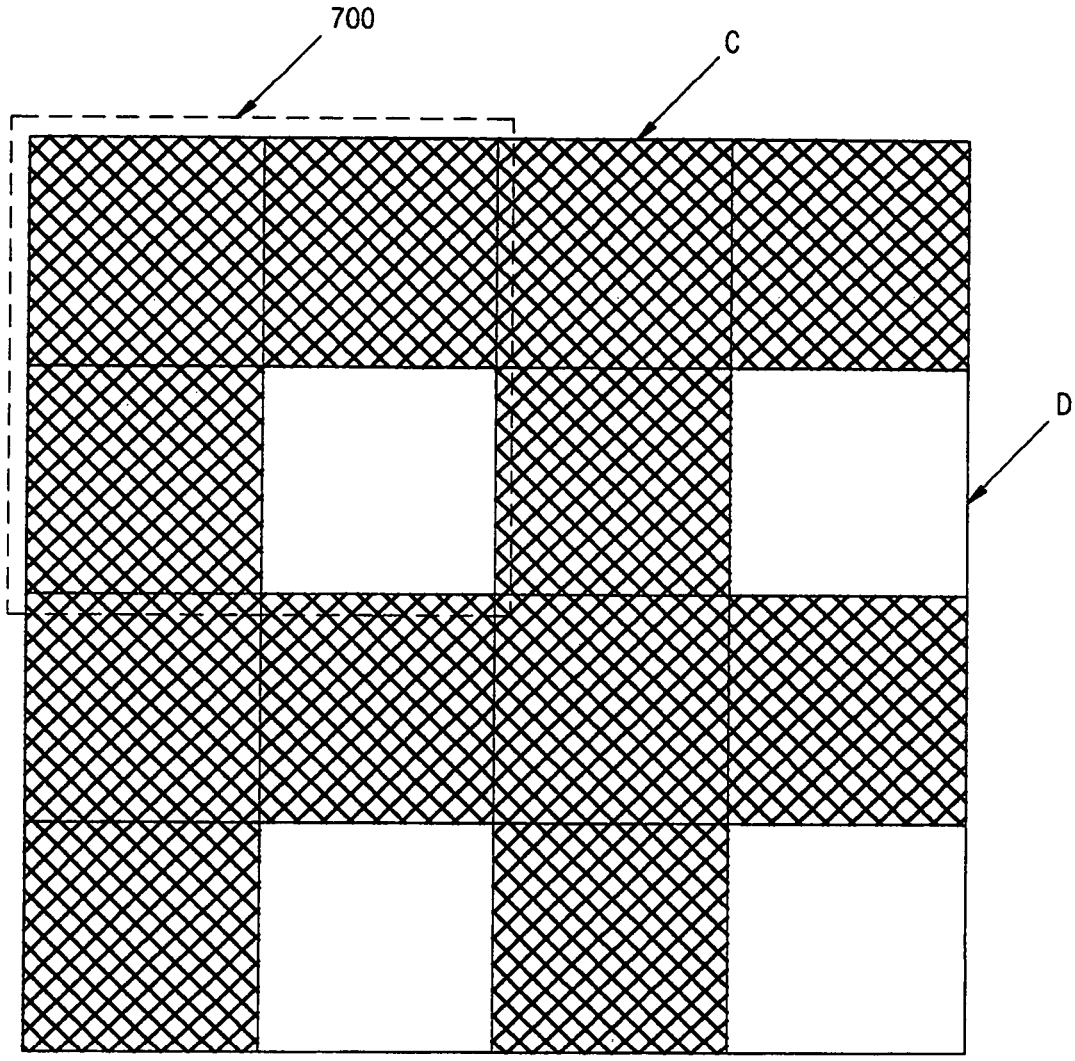
FIG. 7 is a view for explaining a method of representing a gray level lower than gray level 1 by using the driving waveform shown in FIG. 5 according to an example arrangement.

A method of representing a gray level lower than a gray level 1 using the driving waveform in FIG. 5 is shown in FIG. 7.

More specifically, FIG. 7 is a view for explaining a method of representing a gray level lower than gray level 1 according to an example arrangement and by using the driving waveform shown in FIG. 5.

Referring to FIG. 7, when it is assumed that the light rays produced by the driving waveform in FIG. 5 represents gray level 2, if there is a need to represent gray level 0.5 in an area composed of 16 discharge cells in the plasma display panel as a whole, the method may control a number of turn-off cells and a number of turn-on cells to represent gray level 0.5 as a whole of the 16 discharge cells. Here, the reason of assumption that the light represents gray level 2 is because it is assumed that one sustain pulse (or signal or waveform) displays gray level 1 for ease of description. According to the driving waveform in FIG. 5, two sustain pulses (or signals or waveforms) are applied to sustain electrodes so that a total of two gray levels can be displayed.

For example, in an area denoted by reference numeral 700 (i.e., the area including 4 discharge cells), a total of light rays emitted in the area 700 can represent gray level 2 with three turn-off discharge cells and one turn-on discharge cell. Accordingly, each discharge cell in the area 700 may represent gray level 0.5. This method is based on optical illusion and is a halftone technique.

A method for supplying only one sustain pulse (or signal or waveform) in the sustain period may further improve image quality in low gray level. One such method is shown in FIG. 8.

Figure 8:
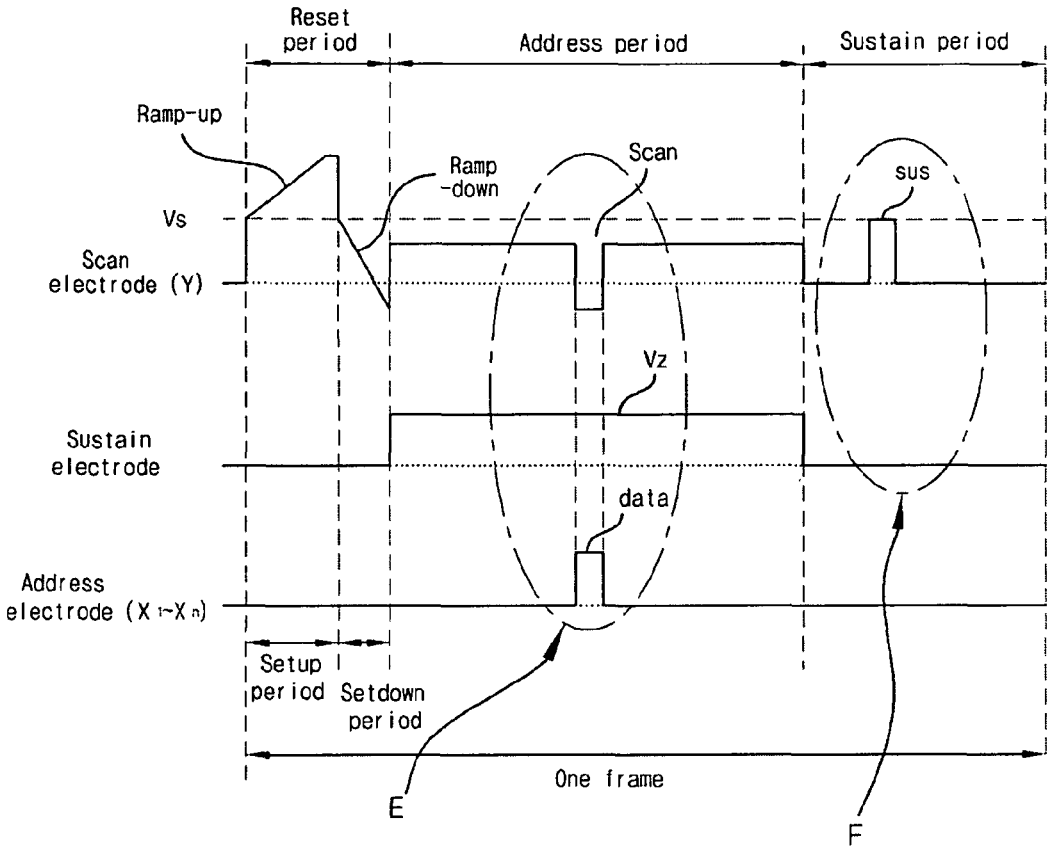
FIG. 8 illustrates a driving waveform in which one sustain pulse is applied in a sustain period to improve image quality in a low gray level according to an example arrangement.

More specifically, FIG. 8 illustrates a driving waveform in which one sustain pulse (or signal or waveform) is applied in the sustain period to improve image quality in a low gray level area according to an example arrangement. Other arrangements are also possible.

More specifically, FIG. 8 shows one sustain pulse (or signal or waveform) applied in one sustain period in a driving method of a plasma display panel to improve image quality in a low gray level. As shown in a portion E in FIG. 8, an address discharge is caused between a scan electrode Y and an address electrode X in the address period. In a portion F in FIG. 8, a sustain discharge is caused between a scan electrode Y and a sustain electrode Z in the sustain period. The driving waveform in the portion F in FIG. 8 is different from the portion B in FIG. 5 in that the sustain discharge is caused by one sustain pulse applied either to the scan electrode Y or to the sustain electrode Z in the sustain period only once.

In other words, the driving waveform in FIG. 8 supplies one sustain pulse to either the scan electrode Y or the sustain electrode Z. That is, the number of sustain pulses supplied in the sustain period is reduced to 1 as compared to the driving waveform in FIG. 5. This may be done to set the shortest subfield capable of representing the lowest gray level so that gray level is delicately represented for low gray level.

The method of representing a gray level lower than gray level 1 using the driving waveform shown in FIG. 8 will be described with reference to FIG. 9.

Figure 9:
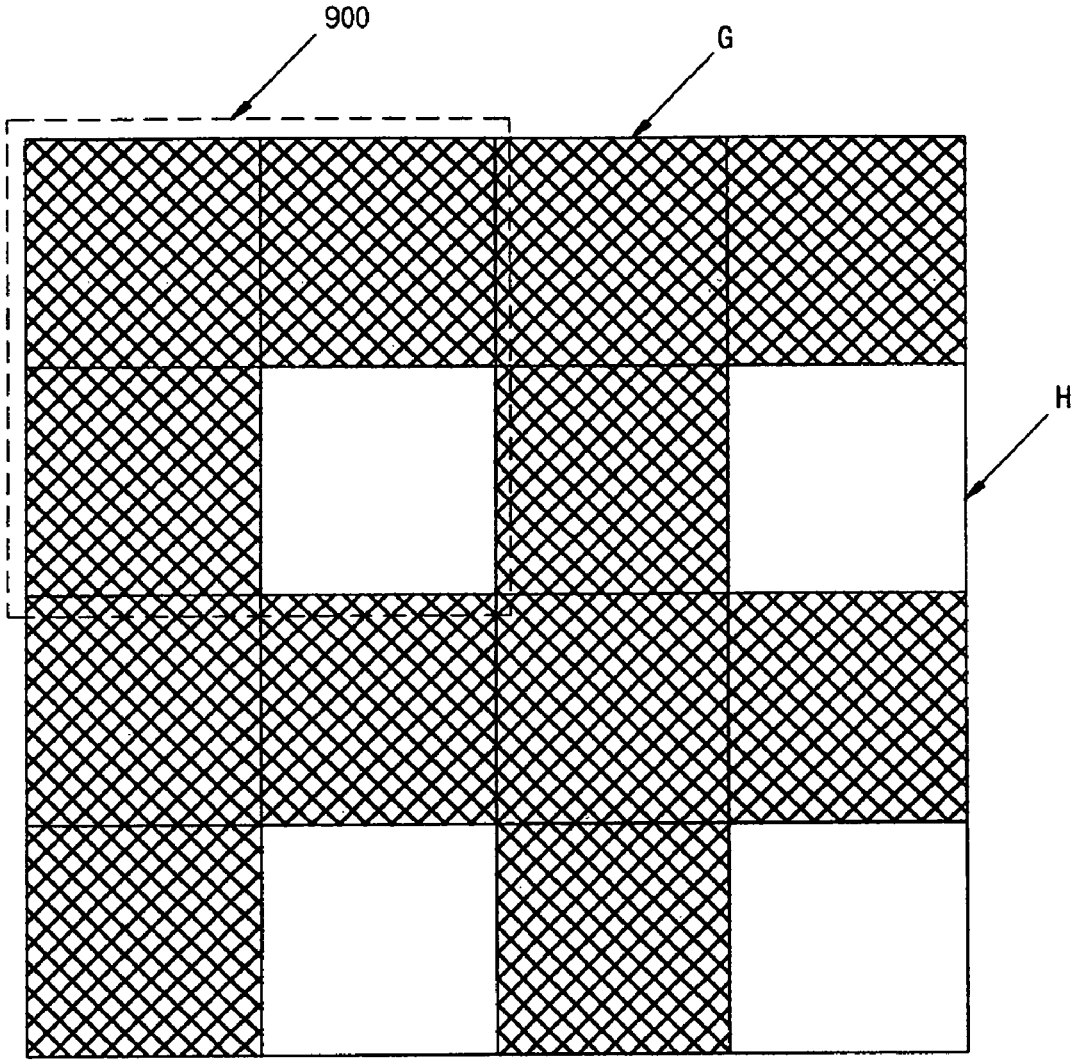
FIG. 9 is a plan view of discharge cells for explaining a method of representing gray levels lower than gray level 1 using the driving waveform shown in FIG. 8 according to an example arrangement.

More specifically, FIG. 9 is a plan view of discharge cells for explaining the method of representing gray levels lower than gray level 1 by using the driving waveform in FIG. 8 according to an example arrangement. Other arrangements are also possible.

More specifically, FIG. 9 shows that the light produced by the driving waveform in FIG. 8 displays gray level 1 and it may represent gray level 0.25 in an area with 16 discharge cells on a plasma display panel. A number of turn-off discharge cells G and a number of turn-on discharge cells H may be controlled to represent gray level 0.25 as a whole of the discharge cells in the area. Here, the reason of assumption that the light has gray level 1 is because it is assumed that one sustain pulse (or signal or waveform) embodies gray level 1 for ease of description.

For example, in an area 900 including 4 discharge cells, if three discharge cells are turned off and one discharge is turned on, the lights in the area 900 may display gray level 1 as a whole. Accordingly, it appears as if each discharge cell in the area 900 displays gray level 0.25.

However, such a method may be disadvantageous in that halftone noise blurring a shape at its boundary may occur, so that image quality may be degraded since luminance difference between turn-on discharge cells and turn-off discharge cells may be so great and the number of turn-on discharge cells may be much smaller than the number of turn-off discharge cells.

A plasma display apparatus and a driving method thereof in accordance with embodiments of the present invention will now be described.

Figure 10:
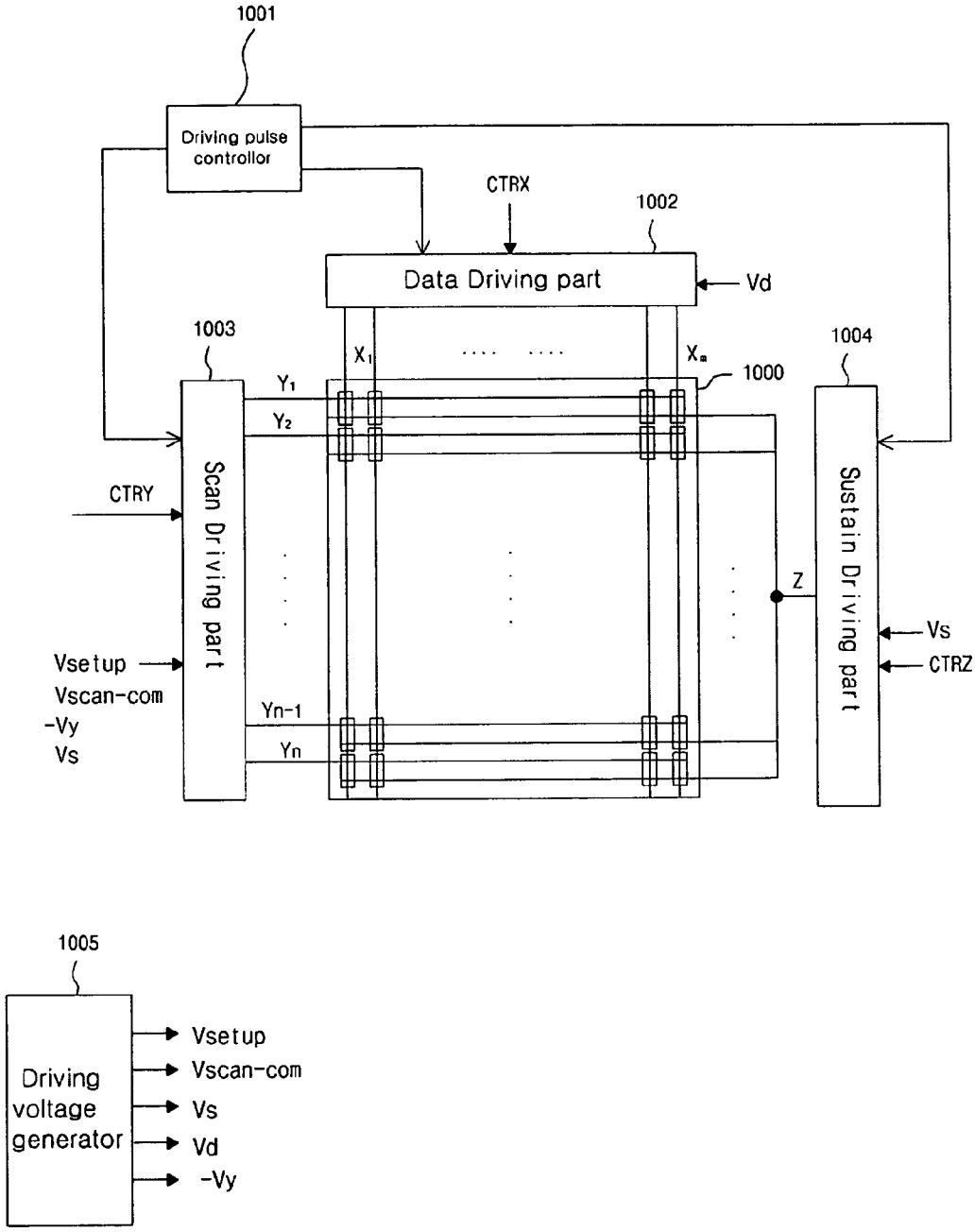
FIG. 10 is a block diagram of a plasma display apparatus according to an example embodiment of the present invention.

FIG. 10 is a block diagram of a plasma display apparatus in accordance with an example embodiment of the present invention. Other embodiments and configurations are also within the scope of the present invention.

A plasma display apparatus in accordance with an example embodiment of the present invention may include a plasma display panel 1000 having scan electrodes Y1 to Yn, sustain electrodes Z, and address electrodes X1 to Xn arranged to intersect the scan electrodes Y1 to Yn and the sustain electrodes Z. The plasma display panel may display an image composed of at least one frame, each being comprised of at least one subfield. A driving pulse (or signal or waveform) may be applied to the address electrodes X1 to Xn, the scan electrodes Y1 to Yn and the sustain electrodes Z in a reset period, an address period, and a sustain period. The apparatus may further include a data driving part 1002 for supplying data to the address electrodes X1 to Xn formed in the panel 1000, a scan driving part 1003 for driving the scan electrodes Y1 to Yn, a sustain driving part 1004 for driving the sustain electrodes Z being a common electrode, a driving pulse controlling part 1005 for controlling the scan pulse driving part 1004 upon driving the plasma display panel 1000, and a driving voltage generating part 1005 for supplying driving voltages to the driving parts 1002, 1003 and 1004.

The plasma display panel 1000 may include a front panel (not shown) and a rear panel (not shown) that are disposed apart by a distance and combined with each other, and further include a plurality of scan electrodes Y1 to Yn and sustain electrodes Z being in pairs, and address electrodes X1 to Xm formed to intersect the scan electrodes Y1 to Yn and the sustain electrodes Z.

The data driving part 1002 may be supplied with data that are reverse-gamma corrected and error diffused by a reverse gamma correction circuit and an error diffusion circuit (not shown in FIG. 10) and then mapped with corresponding subfields by a subfield mapping circuit. The data driving part 1002 supplies (or applies) the supplied data to the address electrodes X1 to Xm in response to the driving pulse controlling part 1001.

The scan driving part 1003 supplies (or applies) a reset pulse (or signal or waveform) including a ramp-up waveform and a ramp-down waveform to the scan electrodes Y1 to Yn in the reset period under the control of the driving pulse controlling part 1001. The scan driving part 1003 sequentially supplies (or applies) a scan pulse Sp (or signal or waveform) with a scan voltage −Vy to the scan electrodes Y1 to Yn in the address period, and supplies (or applies) a sustain pulse SUS (or signal or waveform) to the scan electrodes Y1 to Yn in the sustain period.

The sustain driving part 1004 supplies (or applies) a bias voltage Vz having a positive level to the sustain electrodes Z in at least one period out of a period that a ramp-down waveform is generated and the address period under the control of the driving pulse controlling part 1001. The sustain electrodes Z are supplied with the scan pulse SUS alternately by the sustain driving part 1004 and the scan driving part 1003.

The driving pulse controlling part 1001 generates a control signal for controlling operation timing and synchronization of the data driving part 1002, the scan driving part 1003 and the sustain driving part 1004 in the reset period, the address period, and the sustain period. The driving pulse controlling part supplies (or applies) the control signal to the data driving part 1002, the scan driving part 1003 and the sustain driving part 1004, thereby driving the data driving part 1002, the scan driving part 1003 and the sustain driving part 1004. The driving pulse driving part 1001 controls the scan driving part 1003 and the sustain driving part 1004 in one or more subfields of the frame so that a voltage difference between the scan electrode Y and the sustain electrode Z or a voltage difference between the scan electrode Y and the address electrode X in the address period of the one or more subfields is greater than that in the other subfields. The one or more subfields in which the voltage difference between the scan electrode Y and the sustain electrode Z or between the address electrode X and the scan electrode Y is greater than that in the other subfields is a low gray level subfield that excludes a sustain period (i.e. that does not include the sustain period) or that includes a sustain period while excluding a sustain pulse (i.e., that does not supply a sustain pulse).

The driving voltage generating part 1005 generates a set-up voltage Vsetup, a scan reference voltage Vsc (or Vscan-com), a negative scan voltage −Vy, a sustain voltage Vs and a data voltage Vd. The level of the driving voltages can be changed due to the composition of discharge gases and a structure of a discharge cell.

The function of the plasma display apparatus will be described below in more detail with regard to a driving method of the apparatus.

The driving method of the plasma display apparatus with such structure in accordance with various embodiments of the present invention will be described below.

Figure 11A:
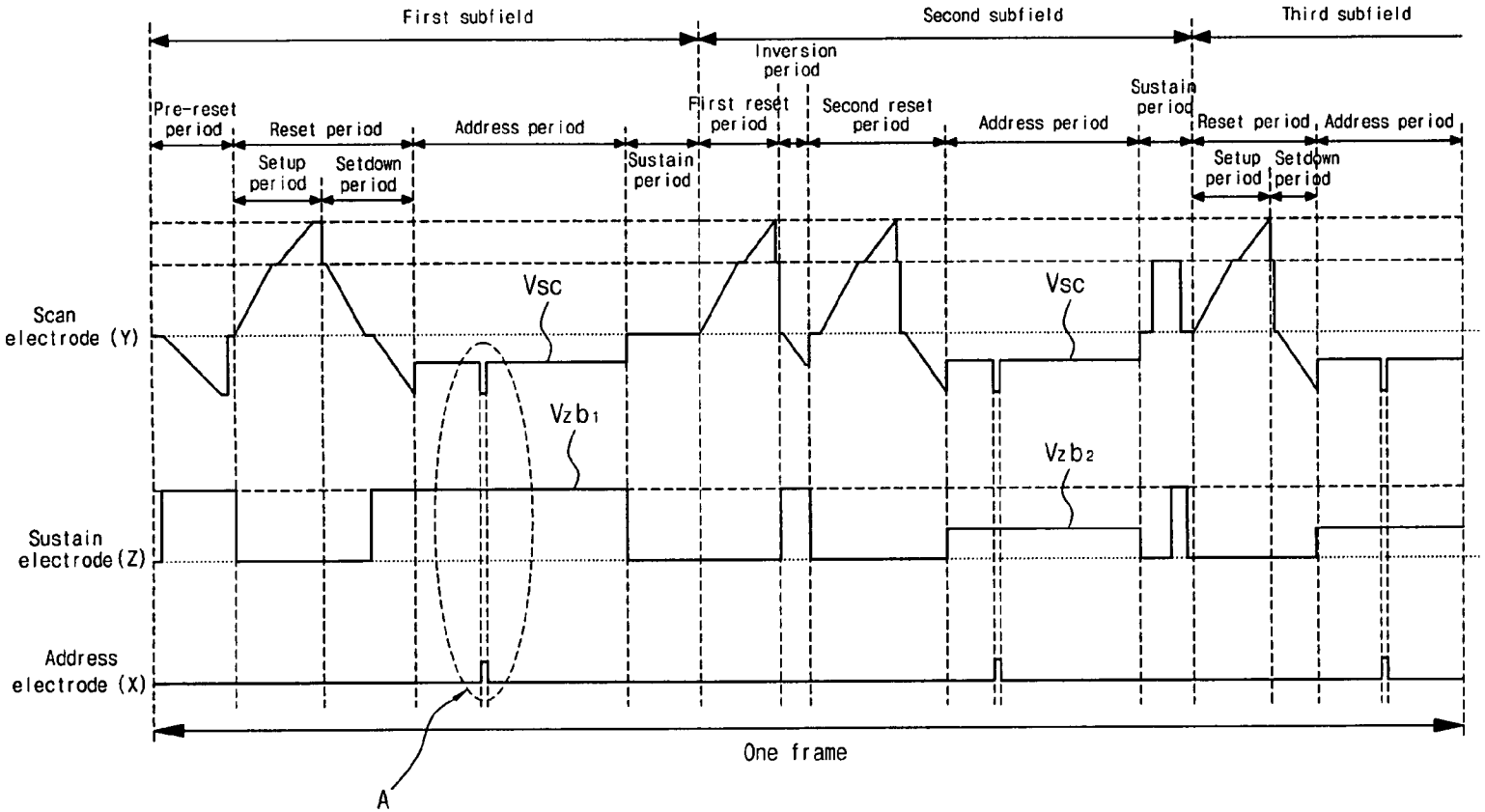
FIGS. 11*a* and 11*b* are driving waveform views of a plasma display apparatus according to a first embodiment of the present invention.
Figure 11B:
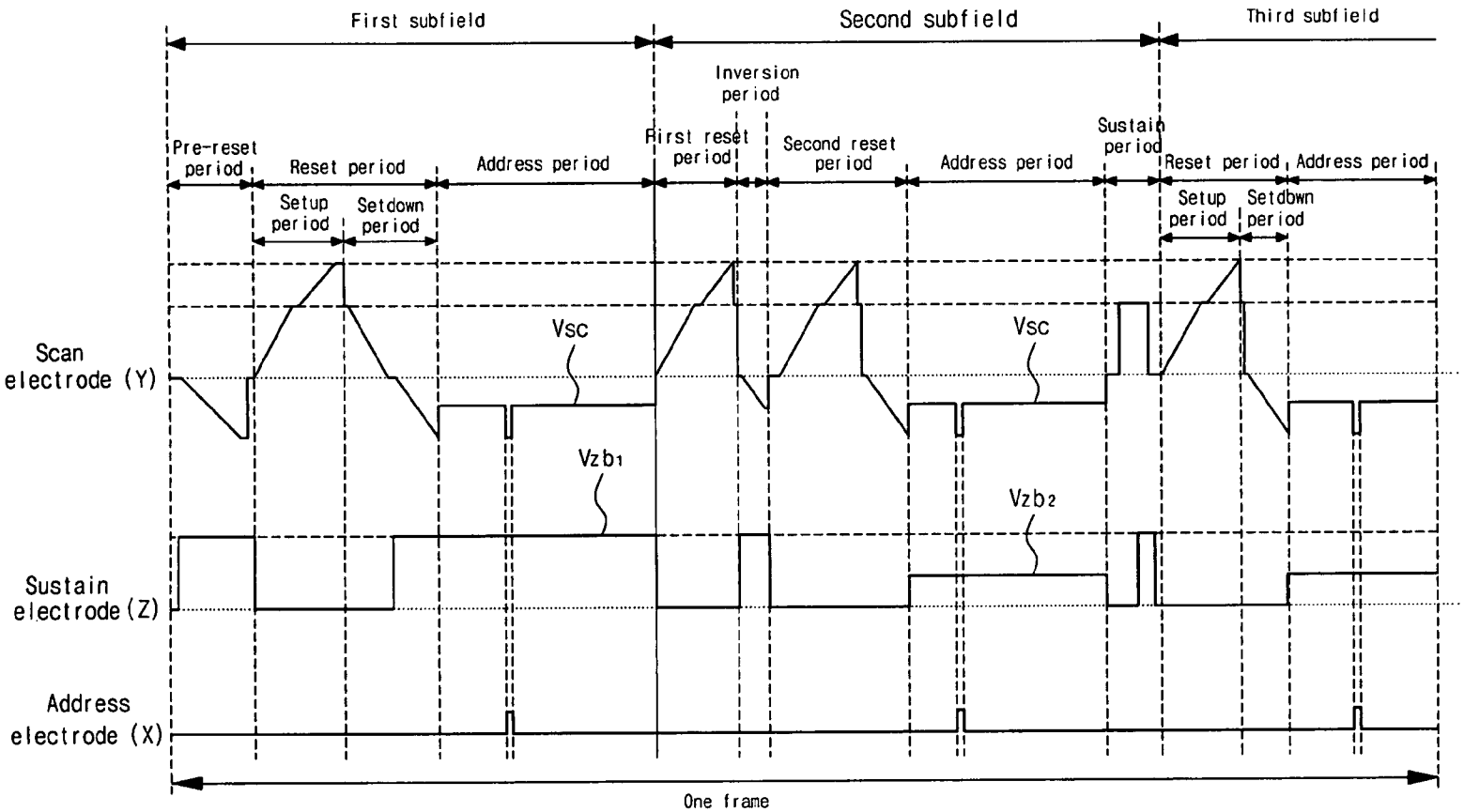

FIGS. 11*a* and 11*b* are driving waveform views of a plasma display apparatus in accordance with a first embodiment of the present invention. Other embodiments and configurations are also within the scope of the present invention.

First, with reference to FIG. 11*a*, no sustain pulse is supplied (or applied) to the scan electrode Y and the sustain electrode Z in the sustain period of one or more subfields of a frame. Further, a voltage difference between the scan electrode Y and the sustain electrode Z or between the scan electrode Y and the address electrode X is greater than in the address period of any other subfields of the frame.

More specifically, in a low gray level subfield among the subfields of the frame, no sustain pulse (or signal or waveform) may be supplied (or applied) to the sustain electrode in the sustain period and a bias voltage supplied (or applied) to the sustain electrode Z may be greater than that in the other subfields so that a voltage difference between the scan electrode Y and the sustain electrode Z in the address period of the low gray level subfield is greater than that in the other subfields.

FIG. 11*b* illustrates a driving method in accordance with the first embodiment of the present invention. With reference to FIG. 11*b*, one or more subfields do not include the sustain period (i.e., there is no sustain period in one or more subfields.) In such subfields, a voltage difference between the scan electrode Y and the sustain electrode Z or between the scan electrode Y and the address electrode Z in the address period is greater than that in the other subfields.

For example, with reference to FIG. 11*a*, in case that no sustain pulse is supplied (or applied) to the scan electrode Y and the sustain electrode Z in a sustain period of a first subfield in a frame, the waveform supplied (or applied) to the sustain electrode in the sustain period of the first subfield is different from that in the other subfields. Further, with reference to FIG. 11*b*, since a first subfield among subfields of a frame does not include a sustain period (i.e., excludes a sustain period), the waveform supplied to the sustain electrode in the first subfield is different from that in the other subfields.

In such a method, the subfield with no sustain period or the subfield with a sustain period in which a sustain pulse is not supplied to the sustain electrode (i.e., a low gray level subfield) is a subfield with the lowest gray level weight (e.g. the first subfield of a frame as shown in FIG. 11*a* and FIG. 11*b*). Further, a bias voltage Vzb1 supplied (or applied) to the sustain electrode Z in the first subfield is greater than a bias voltage in the other subfields.

In the subfield with no sustain period or the subfield with a sustain period in which a sustain pulse is not supplied (or applied) in the sustain period to the sustain electrode (i.e., a low gray level subfield) a voltage difference between the scan electrode Y and the sustain electrode Z in the sustain period following the address period may be smaller than the sustain voltage Vs. Here, since the scan electrodes Y and the sustain electrodes are not supplied with the sustain pulse in the sustain period, the voltage difference between the scan electrode Y and the sustain electrode Z is smaller than the sustain voltage Vs. Accordingly, sustain discharge does not occur in the low gray level subfield.

Further, in case that there is no sustain period in a subfield, sustain discharge is not caused in the subfield.

Figure 12:
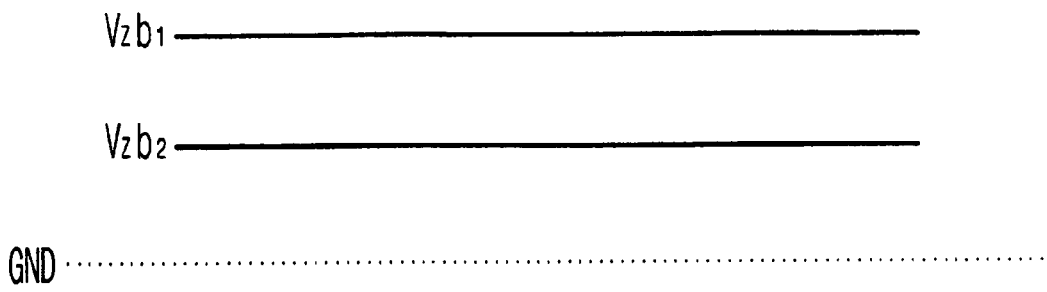
FIG. 12 is a view for explaining a magnitude of a bias voltage Vzb applied to a sustain electrode Z in the driving waveform shown in FIG. 11*a* and FIG. 11*b* according to an example embodiment of the present invention.

With reference to FIGS. 11*a-b* and FIG. 12, in a subfield in which a sustain pulse (or signal or waveform) supplied in a sustain period is omitted (i.e., any of the sustain electrode Z and the scan electrode Y is not supplied with the sustain pulse in the sustain period) or in a subfield with no sustain period, the lowest gray level may be realized by setting up the bias voltage Vzb with a positive level supplied to the sustain electrode Z to be higher than the bias voltage in the other subfields. For example, as shown in FIG. 11*a*, gray levels may be represented only by the address discharge caused due to the data pulse supplied to the address electrode X and the scan pulse supplied to the scan electrode Y while the sustain pulse is not supplied to the sustain electrode in the sustain period.

The bias voltage Vzb supplied to the sustain electrode Z in the driving waveforms shown in FIG. 11*a* and FIG. 11*b* will be described with reference to FIG. 12.

As shown in FIG. 11*a* and FIG. 11*b*, the driving waveform may have a pre-reset period in (or before) the first subfield with the lowest gray level weight out of all the subfields in a frame. That is, a pre-reset period may be before a reset period of the first subfield with the lowest gray level weight.

In the pre-reset period (i.e., before the reset period), positive wall charges may be accumulated over the scan electrode Y and negative wall charges may be accumulated over the sustain electrode Z. Accordingly, the width of the reset pulse supplied (or applied) to the scan electrode Y in the reset period may be reduced, thereby increasing reset efficiency. Further, a plasma display apparatus may be effectively driven with a relatively lower reset voltage (i.e., a relatively lower set-up voltage) thereby reducing a total manufacturing cost of the plasma display apparatus.

In such a pre-reset period, the scan electrode Y is supplied with a ramp-down waveform decreasing gradually from a ground level GND, and the sustain electrode Z is supplied with a constant positive voltage (sustain voltage Vs).

The pre-reset period is followed by the reset period including a set-up period in which the scan electrode Y is supplied with a ramp-up waveform increasing gradually from the ground level GND and a set-down period in which the sustain electrode Z is supplied with a ramp-down waveform decreasing gradually from a predetermined reference voltage (i.e., preferably the sustain voltage Vs).

As described above, in the subfield having the pre-reset period at its early stage (i.e., the first subfield as shown in FIG. 11*a* and FIG. 11*b*), the scan electrode Y is supplied with the ramp-up waveform gradually increasing in the set-up period and is supplied a ramp-down waveform decreasing gradually from a positive voltage lower than a peak voltage of the ramp-up waveform (i.e., the sustain voltage Vs) in the set-down period.

Further, the sustain electrode Z is supplied with a constant voltage (i.e., ground level GND) as long as the ramp-down waveform supplied to the scan electrode Y is higher than the ground level GND in the set-up and set-down periods.

The reset period is followed by an address period for selecting discharge cells to be on or off of the discharge cells in the plasma display panel.

Meanwhile, in the first subfield in driving waveforms in FIG. 11*a* and FIG. 11*b*, the bias voltage Vzb1 supplied (or applied) to the sustain electrode Z in the set-down period of the reset period and the address period in the first subfield may be higher than the bias voltage in the other subfields in FIG. 12.

FIG. 12 is a view for explaining a bias voltage Vzb applied to the sustain electrode Z in the driving waveform shown in FIG. 11*a* and FIG. 12.

Referring to FIG. 12, as shown in FIG. 11*a* and FIG. 11*b*, in the first subfield with the lowest gray level weight among the subfields of a frame, the bias voltage Vzb1 is applied to the sustain electrode Z in the set-down period in which the set-down pulse is applied to the scan electrode and the address period in which the scan pulse is applied to the scan electrode, and the bias voltage Vzb1 is higher than the other subfields, from the second to eighth subfields of the frame. Here, the bias voltage Vzb1 applied to the sustain electrode Z in the first subfield with the lowest gray level weight among the subfields of one frame may be 1.5 to 2.5 times greater than the bias voltages of the other subfields. The bias voltage applied to the sustain electrode Z in the first subfield with the lowest gray level weight may range from 250V to 500V.

For example, in case that a total of 8 subfields constitute one frame, if the bias voltage Vzb2 in the other subfields from the second subfield to the eighth subfield is 100V, for example, then the bias voltage Vzb1 in the first subfield with the lowest gray level weight may range from 150V to 250V. In such a manner, in the driving waveforms in FIG. 11*a* to FIG. 11*b*, the bias voltage Vzb1 supplied to the sustain electrode Z in the first subfield with the lowest gray level weight is the sustain voltage Vs.

Meanwhile, light rays emitted in one subfield are produced substantially due to the sustain discharge caused by the sustain pulse applied in the sustain period, and the amount of light rays produced due to the address discharge caused by the scan pulse applied to the scan electrode Y in the address period and by the data pulse applied to the address electrode X in the address period is smaller than the light rays produced by the sustain discharge.

Accordingly, in the subfield in which the sustain discharge is not caused such as the first subfield shown in FIG. 11*a* and FIG. 11*b*, a relatively small amount of light rays are radiated as compared with the arrangement in FIG. 8 in which only one sustain pulse (or signal or waveform) is applied in one sustain period.

As described above, address discharge caused in the address period in a subfield becomes relatively stronger as the bias voltage Vzb applied to the sustain electrode Z in the subfield becomes greater than that in the other subfields. The reason is that a voltage difference between the scan electrode Y supplied with the scan pulse and the sustain electrode Z becomes relatively greater so that the number of wall charges involved with the address discharge caused due to the scan electrode Y and the address electrode Z increases upon the address discharge in the address period. Accordingly, the amount of light rays radiated in the address period may increase. Meanwhile, since the sustain period is not supplied with the sustain pulse or the sustain period does not exist in a subfield, the amount of light rays radiated in the corresponding subfield may be determined according to an intensity of the address discharge caused in the address period.

As a result, a subfield in a frame may be controlled to not include a sustain period or to include a sustain period that is not supplied with a sustain pulse so that the subfield radiates a smaller amount of light rays as compared with a subfield supplied with only one sustain pulse. This may increase gray level representation capability in low gray level. Further, at this time, the bias voltage Vz applied to the sustain electrode Z in the subfield may be higher than that in the other subfields to stabilize address discharge which is able to be weak.

As described above, in a subfield that does not include a sustain period or is not supplied with a sustain pulse in a sustain period thereof, among subfields of one frame (i.e., the first subfield in FIG. 11*a* and FIG. 11*b*) the bias voltage Vzb1 applied to the sustain electrode Z may be set up to be higher than the bias voltage in the other subfields. Additionally, a voltage difference between a scan reference voltage Vsc applied to the scan electrode Y and the bias voltage Vzb1 applied to the sustain electrode Z in an address period may be greater than a voltage difference in the other subfields. In such a subfield that does not include a sustain period or is not supplied with a sustain pulse in a sustain period thereof, the voltage difference between the scan reference voltage Vsc and the bias voltage Vzb1 may be 1.5 times greater than the sustain voltage Vs. The voltage difference between the bias voltage Vzb1 applied to the sustain electrode Z and the scan reference voltage Vsc applied to the scan electrode Y in the low gray level subfield may be greater than 250V.

In such a subfield that does not include a sustain period or is not supplied with a sustain pulse in a sustain period thereof, the voltage difference between the scan reference voltage Vsc and the bias voltage Vzb1 may be greater than the voltage difference in the other subfields so that the intensity of light rays radiated due to the address discharge becomes sufficient to represent gray levels by making the address discharge strong.

As described above in detail with reference to FIG. 11*a* and FIG. 11*b*, a subfield may be controlled so as not to include a sustain period or to include a sustain period without a sustain pulse in a sustain period thereof. In such circumstance, since the voltage difference between the bias voltage Vzb1 maintained during the address period of the subfield described above and the scan reference voltage Vsc is relatively greater than the voltage difference in the other subfields, self-erase discharge can be easily caused during the address period and a reset period of the next subfield. Accordingly, a self-erase prevention pulse (or signal or waveform) may be supplied (or applied) after the data pulse is supplied during the address period of the corresponding subfield and before the reset period of the next subfield to prevent the self-erase discharge. Such self-erase prevention operation will be described with reference to FIGS. 13*a-b* or FIGS. 14*a-b*.

Figure 13A:
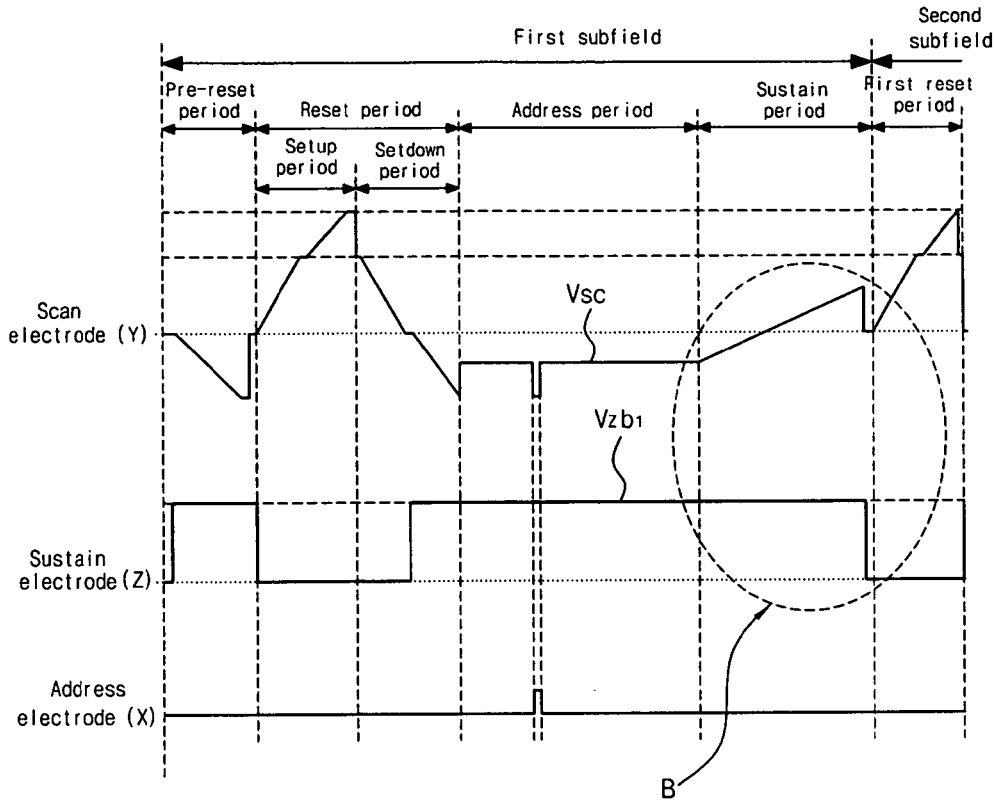
FIG. 13*a* to FIG. 13*b* are driving waveform views for showing an example of a self-erase prevention pulse supplied in a subfield, shown in FIG. 11A and FIG. 11B, wherein a sustain pulse is supplied in a sustain period of the subfield or a sustain period is not included in the subfield.
Figure 13B:
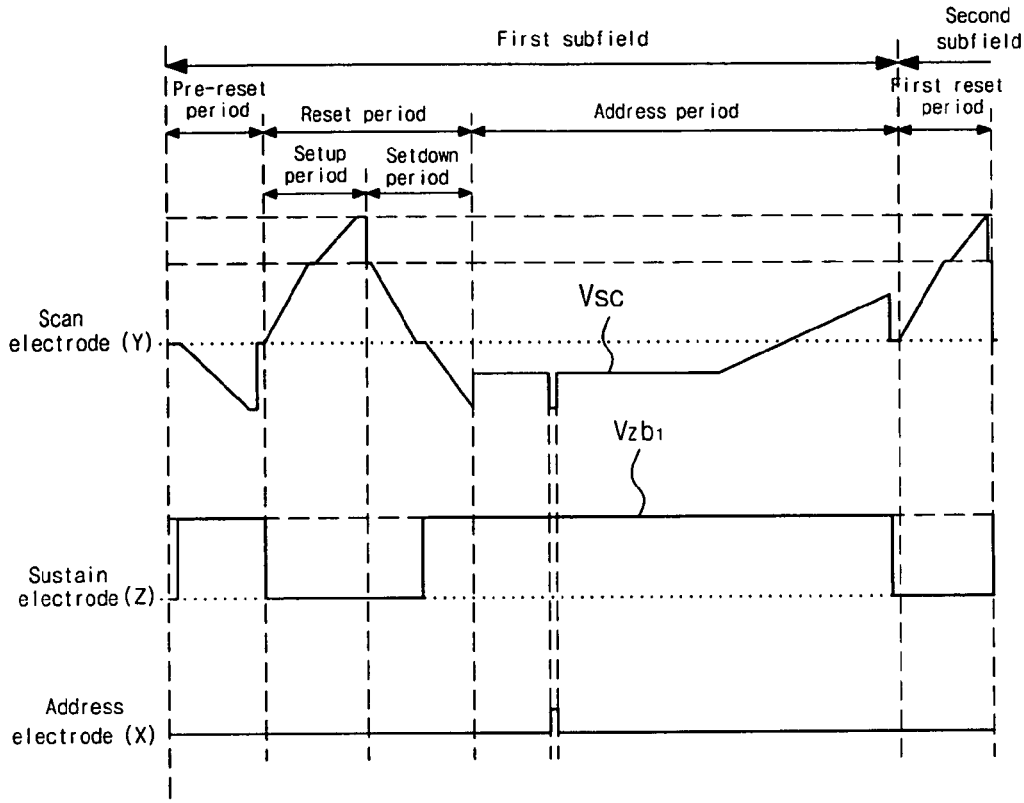

FIG. 13*a* and FIG. 13*b* are views for explaining a self-erase prevention pulse (or signal or waveform) supplied to prevent self-erase discharge in the subfield that does not include a sustain period or is not supplied with a sustain period according to an example embodiment of the present invention. Other embodiments and configurations are also within the scope of the present invention.

Referring to FIG. 13*a*, a subfield that is not supplied with a sustain pulse in a sustain period thereof (i.e., the first subfield in the driving waveform shown in FIG. 11*a*) may include a self-erase prevention pulse (or signal or waveform) applied in the sustain period to prevent the self-erase discharge.

Alternatively, in the subfield that does not include a sustain period as shown in FIG. 13*b* (i.e., in the first subfield of the driving waveform in FIG. 11*b*), a self-erase prevention pulse (or signal or waveform) may be applied in an address period to prevent self-erase discharge.

Such a self-erase prevention pulse may be applied in a sustain period to prevent self-erase discharge after a data pulse (or signal or waveform) is applied in an address period and before a reset period of a next subfield, in a subfield that does not include a sustain period or is not supplied with a sustain pulse in a sustain period thereof (i.e., in the subfield in which a voltage difference between a scan reference voltage Vsc and a bias voltage Vzb1 in an address period is greater than a voltage difference in the other subfields).

Such a self-erase prevention pulse may include a ramp-up waveform increasing gradually, which is applied to a scan electrode Y during a period that a bias voltage Vzb1 is applied to a sustain electrode Z. The gradient of the ramp-up waveform can be steeper as the voltage difference between the scan reference voltage Vsc and the bias voltage Vzb1 becomes greater. For example, in cases that the voltage differences between the scan reference voltage Vsc and the bias voltage Vzb1 are 400V and 600V, respectively, if the gradient of the ramp-up waveform of the self-erase prevention pulse applied to the scan electrode Y is the same, a time to reduce the voltage difference between the scan reference voltage Vsc and the bias voltage Vzb1 is longer in case that the voltage difference is 600V as compared with the case that the voltage difference is 400V. Accordingly, a total length (time) of the subfield may become different for each of the cases, the cases that the voltage differences are 400V and 600V, respectively, so that it is difficult to ensure a driving margin of the plasma display panel. Accordingly, the gradient of the ramp-up waveform may be steeper than the voltage difference between the scan reference voltage Vsc, and the bias voltage Vzb1 becomes greater.

An example will now be discussed when a self-erase prevention pulse is not applied (or supplied) during a period after a data pulse is applied and before a reset period of a next subfield, in the subfield that does not include a sustain period or is not supplied with a sustain pulse in a sustain period thereof. In the subfield that does not include a sustain period or is not provided with a sustain pulse in a sustain period thereof, a voltage difference between the scan reference voltage Vsc and the bias voltage Vzb1 may be relatively great. Accordingly, such voltage difference between the scan reference voltage Vsc and the bias voltage Vzb1 should be settled to set up a voltage of the scan electrode Y and the sustain electrode Z to be the ground level GND to apply a reset pulse in the sustain period or the next subfield after the address period. For example, when the scan reference voltage Vsc is −200V and the sustain voltage Vs is +200V in an address period, sufficient wall voltage, for example 300V of wall voltage, may be formed in the discharge cells due to the voltage difference of 400V. In such a circumstance, if the voltage difference between the scan electrode Y and the sustain electrode Z becomes zero, discharge is caused due to the sufficient wall voltage (e.g., 300V of the wall voltage) in the discharge cell. In such a way, in the circumstance that a voltage is not supplied from outside, if a self-discharge occurs due to the wall voltage inside of the discharge cell, wall charges in the discharge cell may be almost erased so that it becomes difficult to use wall charges in the discharge cell in a subsequent reset discharge. Accordingly, a wrong discharge may occur. To solve such a problem, the self-erase prevention pulse may be applied between the address period of the corresponding subfield and the reset period of the next subfield.

Figure 14A:
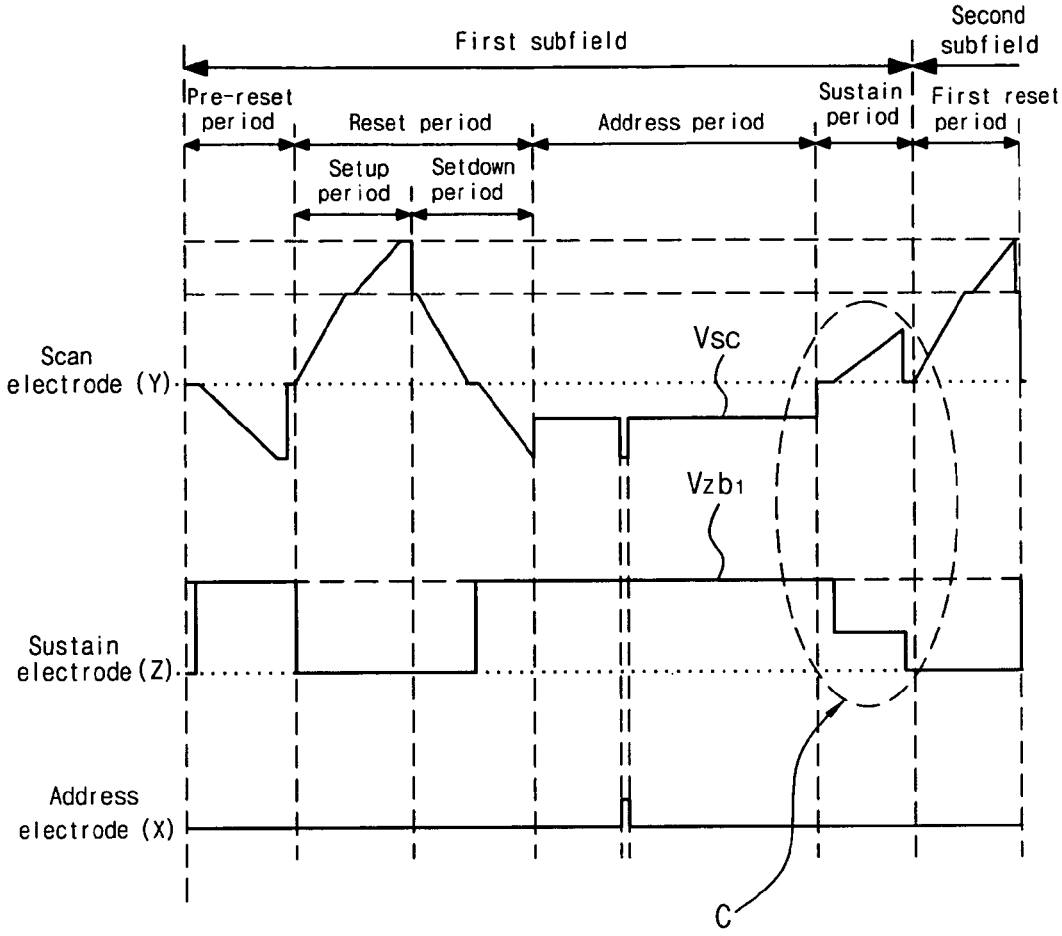
FIG. 14*a* and FIG. 14*b* illustrate an exemplary self-erase prevention pulse supplied to prevent self-erase discharge in a subfield which does not include a sustain pulse supplied in a sustain period or a sustain period therein.
Figure 14B:
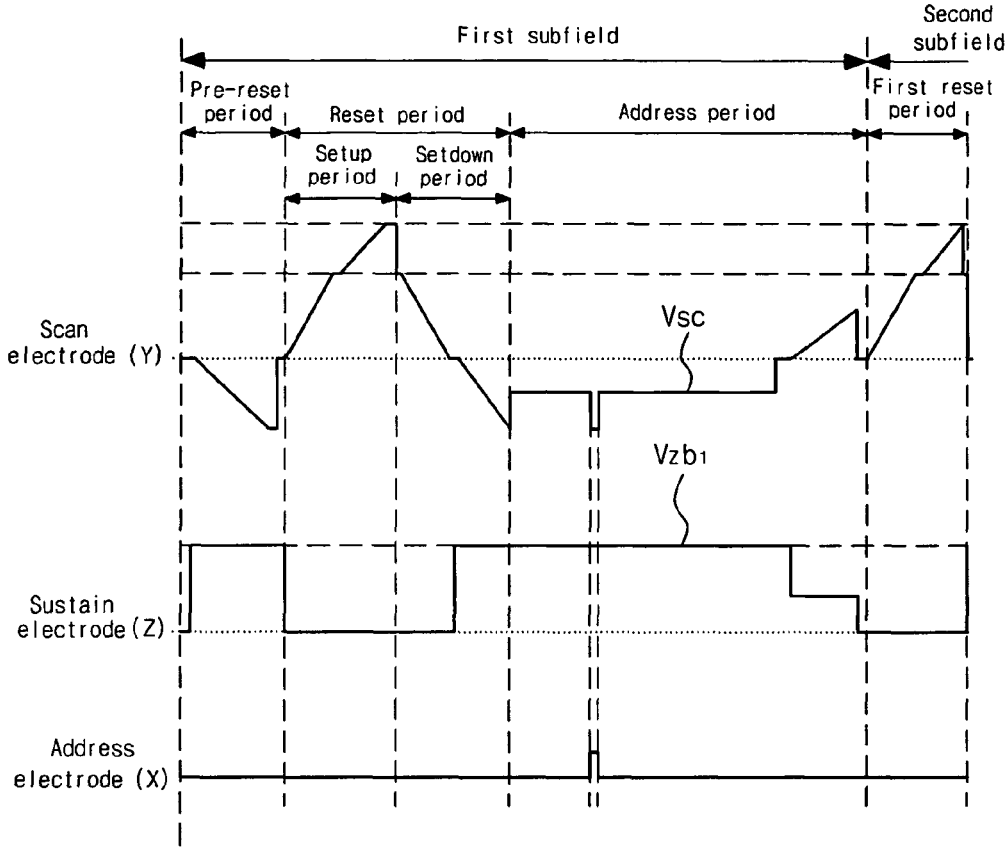

FIG. 14*a* and FIG. 14*b* illustrates an exemplary self-erase prevention pulse (or signal or waveform) applied to prevent a self-erase discharge during a period after a data pulse is applied in an address period in the subfield that does not include a sustain period or is not supplied with a sustain pulse in a sustain period thereof as shown in FIG. 11*a* and FIG. 11*b* and before a reset period of a next subfield is supplied.

FIG. 14*a* and FIG. 14*b* relate to a pulse (or signal or waveform) different from the self-erase prevention pulse shown in FIG. 13*a* and FIG. 13*b*. That is, a self-erase prevention pulse as in FIGS. 14*a-b* may include a ramp-up waveform supplied (or applied) to a scan electrode Y and a positive voltage pulse (or signal or waveform), which is higher than the ground level GND, supplied to the sustain electrode Z in a period that a gradually rising ramp-up pulse (or signal or waveform) is supplied to the scan electrode Y and lower than the sustain voltage Vs supplied to the sustain electrode Z. FIG. 14*a* illustrates a self-erase prevention pulse for when the low gray level subfield is not supplied with a sustain pulse in a sustain period thereof. FIG. 14*b* illustrates a self-erase prevention pulse for when the low gray level subfield does not include a sustain period. Such self-erase prevention pulses (or signals or waveforms) may be supplied in a sustain period to prevent self-erase discharge, during a period after a data pulse is supplied in an address period of the corresponding subfield and before a reset period of a next subfield is supplied, in the subfield that does not include a sustain period or is not supplied with a sustain pulse in a sustain period thereof (i.e., in the subfield in which a voltage difference between the scan reference voltage Vsc and the bias voltage Vzb2 is greater than that in the other subfields).

In FIG. 14*a* and FIG. 14*b*, the positive voltage of the self-erase prevention pulse is preferably 0.5 times greater than the bias voltage Vzb1 applied to the sustain electrode Z in the subfield that does not include a sustain period or is not supplied with a sustain pulse in a sustain period thereof (i.e., in the first subfield with the lowest gray level weight). Accordingly, the positive voltage of the self-erase prevention pulse may be Vzb1/2.

Meanwhile, as described above, in the subfield that does not include a sustain period or is not supplied with a sustain pulse in a sustain period thereof, wrong discharge may occur since the sustain discharge is not caused. As a result, discharge in the next subfield becomes unstable, thereby reducing the driving margin of the next subfield. The reduction of driving margin may be caused because wall voltage becomes different for each discharge cell coated with different fluorescent substances as the discharge is relatively weak in the subfield that does not include a sustain period or is not supplied with a sustain pulse in a sustain period thereof. Such reason will be described in more detail with reference to FIG. 15.

FIGS. 15*a-c* are views for explaining a wall voltage difference between different discharge cells, wherein such difference is caused due to the sustain period omission or sustain pulse omission in a sustain period in the subfield that does not include a sustain period or is not supplied with a sustain pulse in a sustain period thereof.

Figure 15:
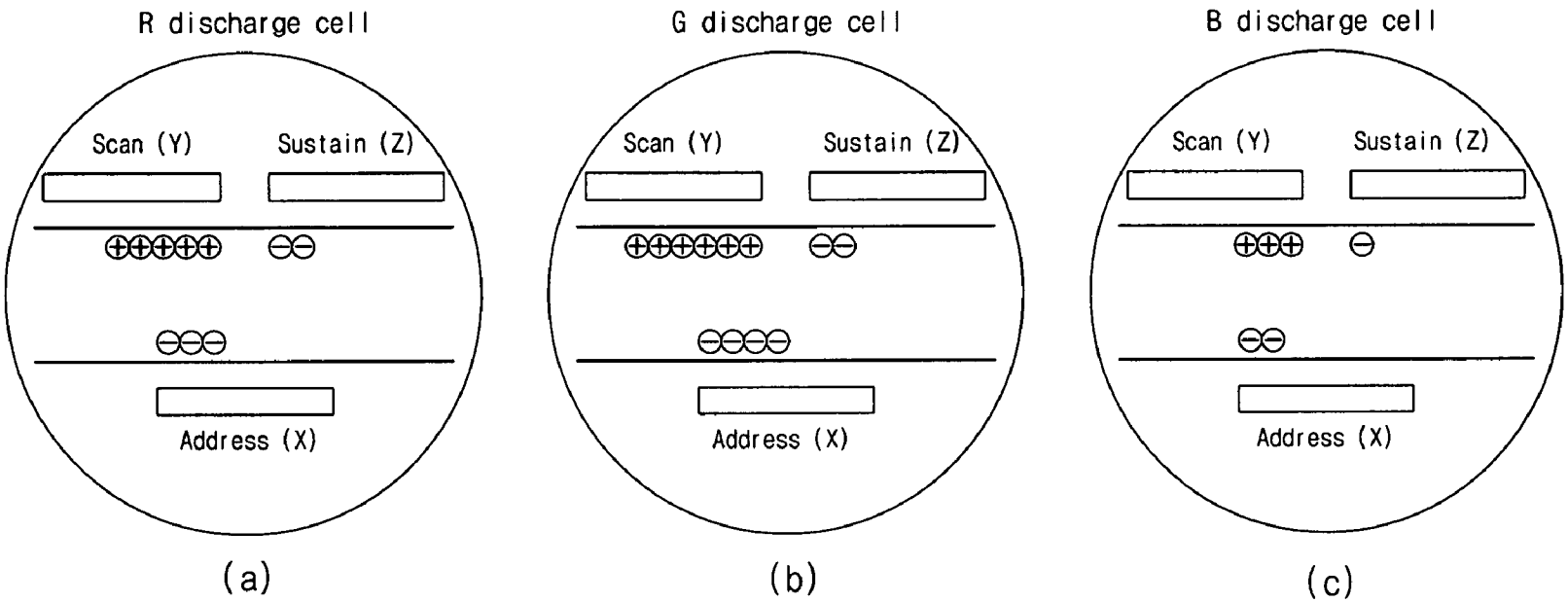
FIG. 15*a-c* are views for explaining a wall voltage difference between different discharge cells, wherein such difference is generated because no sustain discharge occurs in a subfield which does not have a sustain pulse to be supplied in a sustain period or a sustain period.

Referring to FIG. 15, in the subfield that does not include a sustain period or includes a sustain period in which any of the scan electrode Y and the sustain electrode Z is supplied with a sustain pulse in a sustain period thereof, since the sustain discharge does not occur, weak discharge may occur for the discharge cells as a whole. Accordingly, in the subfield without sustain discharge, wall voltages in discharge cells with different fluorescent substances therein are different. For example, as shown in FIG. 15, a total of five (5) positive charges are accumulated over a scan electrode Y, a total of two (2) negative charges are accumulated over a sustain electrode Z, and a total of three (3) negative charges are accumulated over an address electrode X in a red discharge cell. Further as shown in FIG. 15*b*, a total of six (6) positive charges are accumulated over a scan electrode Y, a total of two (2) negative charges are accumulated over a sustain electrode Z, and a total of six (6) negative charges are accumulated over an address electrode X in a green discharge cell. Further as shown in FIG. 15*c*, a total of three (3) positive charges are accumulated over a scan electrode Y, a total of one (1) negative charge is accumulated over a sustain electrode Z, and a total of two (2) negative charges are accumulated over an address electrode X in a blue discharge cell. That is, the amount of the wall charges accumulated in the red (R), green (G), blue (B) discharge cells is different for each discharge cell. Accordingly, the wall voltage of the red (R), green (G), blue (B) discharge cells are different for each cell. FIG. 15 illustrates distribution of wall charges at a last stage of the subfield with a sustain period in which a sustain discharge does not occur (i.e., distribution of wall charges before a reset period of a next subfield begins.)

The following relates to why the wall voltage different from one another in each of the red (R), green (G), blue (B) discharge cells is generated within the discharge cell where the sustain discharge is not generated. That is, the reason is that the red (R), green (G), blue (B) phosphors, each being formed within the red (R), green (G), blue (B) discharge cells and having a different characteristic of light emission, do not cause the discharge with an intensity to compensate the different characteristics of light emission at the subfield where the sustain pulse is not supplied (or applied) or the sustain period is not included.

Accordingly, as described above, the difference of the wall voltages between the discharge cells having the different phosphors is generated at the subfield where the sustain pulse is not supplied (or applied) or the sustain period is not included, and is sequentially maintained at the next subfield. This may reduce the driving margin at the further next subfield where the sustain pulse is not supplied or the sustain period is not included.

In order to prevent (and/or minimize) the erroneous discharge and the reduction of the driving margin resulting from characteristics of the light emission of the different phosphors, the reset pulse is set to a plural number at the next subfield sequential to the subfield where the sustain pulse is not supplied or the sustain period is not included. For example, as shown in FIGS. 11*a* and 11*b*, a plurality of the reset pulses (or signals or waveforms) are supplied (or applied) in the reset period of the second subfield following the subfield where the sustain pulse is not supplied or the sustain period is not included (i.e., the first subfield). In other words, at the second subfield sequential to the first subfield, the plurality of reset pulses are supplied (or applied) to the scan electrode in the reset period.

Figure 17:
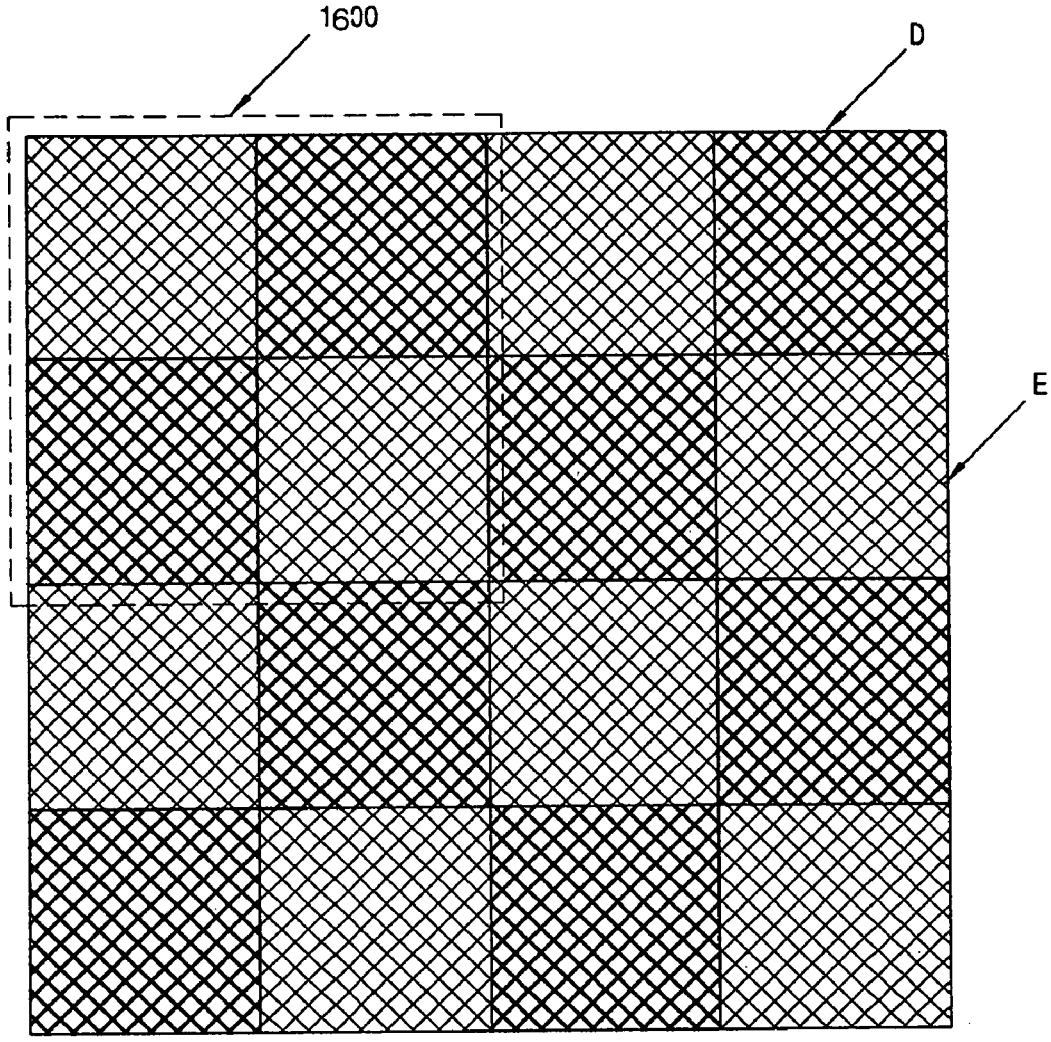
FIG. 17 illustrates another example embodiment of a method of representing a low gray level of decimal number lower than gray level 1 using the driving waveforms shown in FIG. 11*a* and FIG. 11*b;*

One reason why the plurality of reset pulses are supplied in the reset period at the subfield where the sustain pulse is not supplied or the sustain period is not included (i.e., at the next subfield sequential to the first subfield such as at the second subfield in FIGS. 11*a* and 11*b*) is to compensate the difference between the wall voltages generated between the discharge cells having the different phosphors, which is caused by not generating the sustain discharge at the first subfield. For example, as shown in FIG. 17, the sustain discharge is not generated by a plurality of reset discharges generated by the plurality of reset pulses, thereby compensating the difference of the wall voltages between the red (R), green (G) and blue (B) discharge cells, which is generated due to a different amount of the wall charges accumulated in the red (R), green (G) and blue (B) discharge cells.

As such, in case where the plurality of reset pulses are supplied (or applied) at the next subfield sequential to the subfield where the sustain pulse is not supplied or the sustain period is not included, as shown in FIGS. 11*a* and 11*b*, the reset period of the second subfield sequential to the first subfield includes a first reset period and a second reset period for respectively supplying (or applying) one reset pulse to the scan electrode. In other words, the reset period of the second subfield is divided into the first reset period and the second reset period, and at each of the first reset period and the second reset period, the reset pulse is supplied.

Here, in the first reset period, a pulse (or signal or waveform) that gradually increases from the ground level (GND) and decreases from the peak of the ramp-up pulse to the ground level (GND) may be supplied to the scan electrode (Y), and a pulse (or signal or waveform) for sustaining the voltage of the ground level (GND) may be supplied to the sustain electrode (Z).

Further, in the second reset period, a pulse (or signal or waveform) that gradually increases from the ground level (GND) decreases from the peak of the ramp-up pulse to the ground level (GND) and then gradually decreases may be supplied to the scan electrode (Y), and the pulse for sustaining the voltage of the ground level (GND) may be supplied to the sustain electrode (Z).

A wall charge inversion period for inverting the distribution of the wall charges within the discharge cell in the first reset period may be included between the first reset period and the second reset period. In the inversion period, the distribution of the wall charge formed within the discharge cell is inverted by the reset discharge using the first reset pulse supplied in the first reset period, thereby more effectively generating the reset discharge using the reset pulse supplied in the second reset period.

In the wall charge inversion period, as shown in FIGS. 11*a* and 11*b*, the ramp-down pulse gradually decreasing from the ground level (GND) is supplied to the scan electrode (Y), and a pulse (or signal or waveform) for sustaining a positive voltage is supplied to the sustain electrode (Z). The positive voltage may be the sustain voltage (Vs).

Methods for representing a low gray level less than 1 (i.e., a decimal-number gray level) using the driving waveforms of FIGS. 11*a* and 11*b* will be described below with reference to FIGS. 16 and 17.

Figure 16:
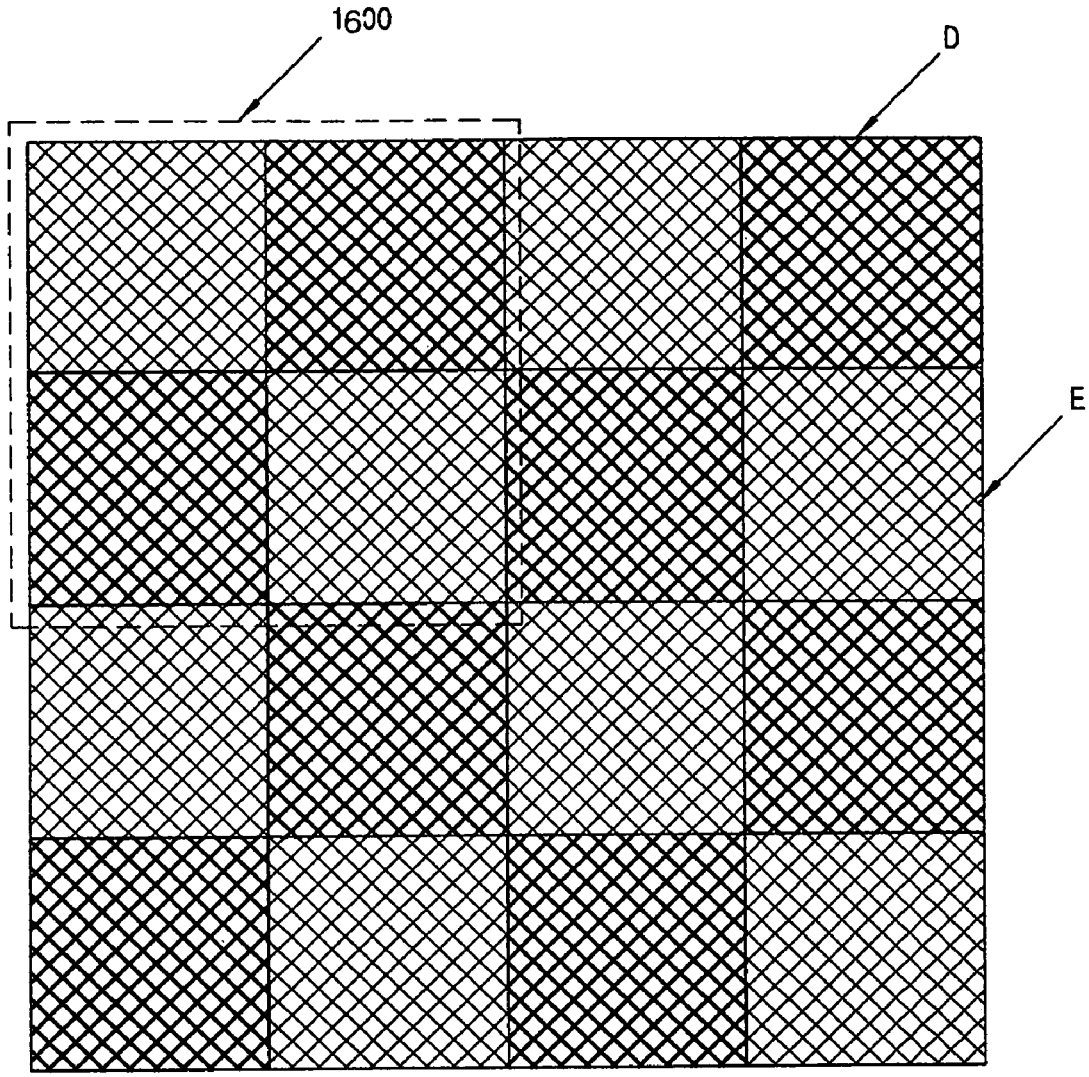
FIG. 16 illustrates an example embodiment of a method of representing a low gray level of decimal number lower than gray level 1 using the driving waveforms shown in FIG. 11*a* and FIG. 11*b;*

FIG. 16 illustrates an example embodiment of a method for embodying the decimal-number gray level of less than 1 in the driving waveform of FIG. 11. Other embodiments are also within the scope of the present invention.

Referring to FIG. 16, a luminance realized by one on-discharge cell may be smaller than that of the driving waveform of FIG. 5 or 8 at the subfield where the sustain pulse is not supplied to any one of the scan electrode (Y) and the sustain electrode (Z) in the sustain period of the driving waveform of FIGS. 11*a* and 11*b*, or the sustain period is not included (i.e., at the first subfield).

As described above, one reason is that the address discharge and the sustain discharge are all generated in FIG. 5 or 8, whereas only the address discharge may be generated without the sustain discharge at the first subfield of the driving waveform of FIGS. 11*a* and 11*b*. Accordingly, a degree of gray level representation is more improved at the low gray level. For example, assuming that one discharge cell generates the light having a gray level of 1 in the driving waveform of FIG. 8 where the gray level embodied by one discharge cell is smaller than that of the driving waveform of FIG. 5, one on-discharge cell generates light having the gray level of less than 1 in FIG. 16.

In FIG. 16, one on-discharge cell embodies the light having a gray level of 0.5. In this case, when a gray level of 0.25 is embodied in a region having a total of sixteen discharge cells of a plasma display panel as shown in FIG. 16, the number of off-discharge cells (D) and on-discharge cells (E) are controlled, thereby entirely embodying the gray level of 0.25. For example, as in a region denoted by a reference numeral of 1600, in a region having four discharge cells, a total of two discharge cells are turned off and two discharge cells are turned on so that a total light generated from the region 1600 becomes a light having the gray level of 1. Accordingly, it appears that each of the discharge cells of the region 1600 embodies the gray level of 0.25.

Comparing a pattern of FIG. 16 with a low gray level pattern of FIG. 9 embodied by the driving waveform of FIG. 8, a greater minute pattern can be used to embody the same gray level of 0.25. In other words, a difference between the luminance of the on-discharge cell and the off-discharge cell may be reduced, and a size of a unitary region for performing a half tone for embodying a predetermined small-number gray level may be reduced in the plasma display panel, thereby decreasing the generation of a half tone noise where images are spread at their boundary. Accordingly, a larger definition image can be embodied.

Unlike FIG. 16, FIG. 17 illustrates a case where the gray level of 0.5 among the small-number gray level of less than 1 is embodied using the driving waveforms of FIGS. 11*a* and 11*b*.

FIG. 17 illustrates another example embodiment of a method for embodying the small-number gray level of less than 1 in the driving waveforms of FIGS. 11*a* and 11*b*. Other embodiments are also within the scope of the present invention.

Referring to FIG. 17, assuming that an amount of light generated by the discharge cell, which is turned-on using the driving waveforms of FIGS. 11*a* and 11*b*, corresponds to the light having the gray level of 0.5 as shown in FIG. 16, when the gray level of 0.5 is embodied in the region having a total of sixteen discharge cells on the plasma display panel of FIG. 16, all discharge cells are turned on, thereby embodying the gray level of 0.5 in average in the region having the total of sixteen discharge cells. Comparing the pattern of FIG. 17 with the pattern of FIG. 7 for embodying the same gray level of 0.5, the half tone noise is not generated due to the absence of the off-discharge cell.

In the driving method of the plasma display panel according to the first embodiment, the subfield where the sustain pulse is not supplied in the sustain period or the sustain period is not included, among the subfields of the frame, is the first subfield as shown in FIGS. 11*a* and 11*b*. However, the subfields where the sustain pulses are not supplied (or applied) or the sustain period is not included in the sustain period within one frame can be plural in number as will be described below in a driving method of a plasma display panel according to a second embodiment of the present invention.

Figure 18:
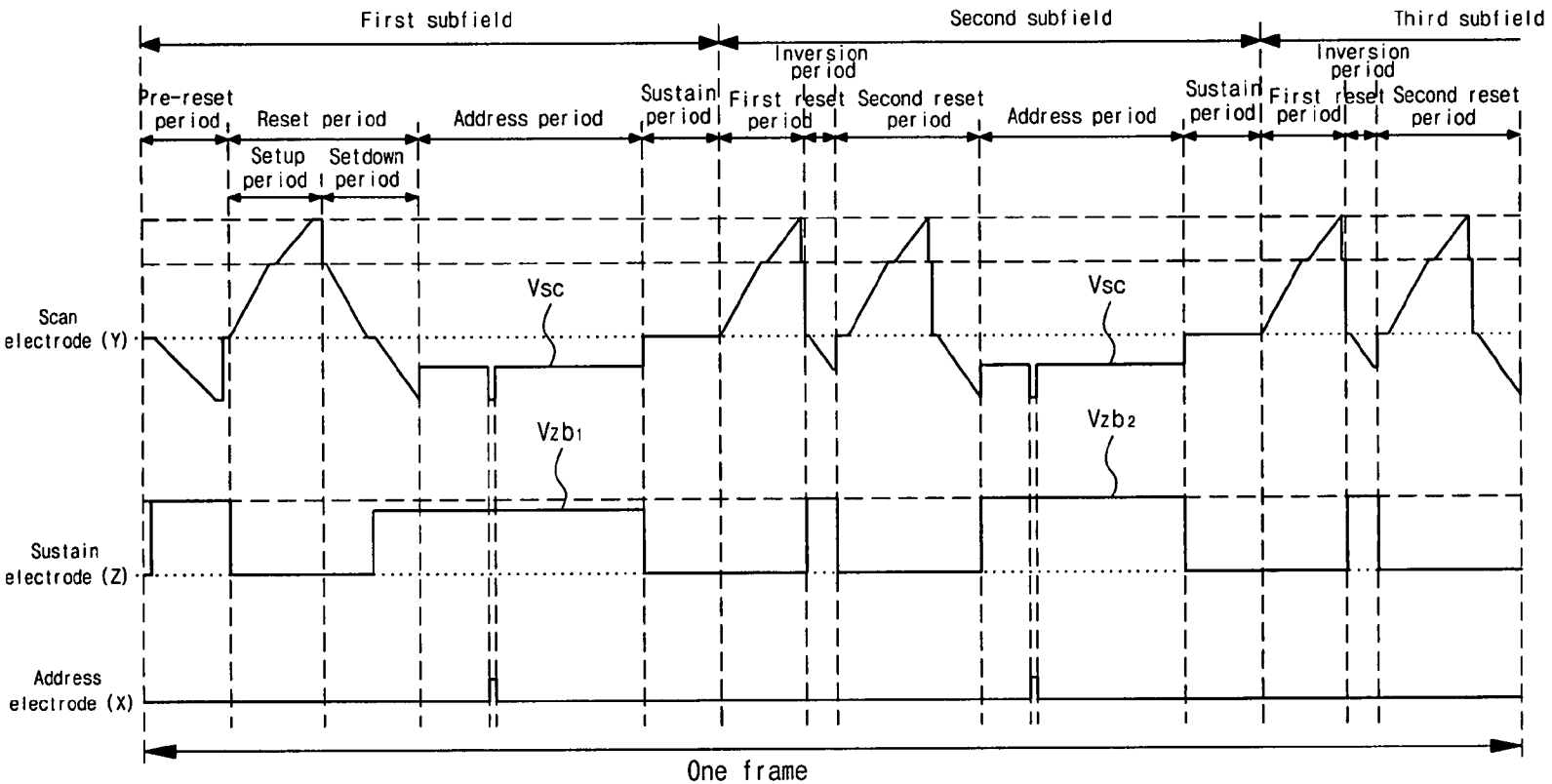
FIG. 18 illustrates a driving method of a plasma display apparatus according to a second embodiment of the present invention.

FIG. 18 illustrates a driving method of the plasma display panel according to a second embodiment of the present invention. Other embodiments and configurations are also within the scope of the present invention.

FIG. 18 illustrates only the subfield where the sustain pulse is not supplied (or applied) in the sustain period. Unlike this, even the subfield where the sustain period is not included can also be illustrated. However, for ease of discussion, the driving method will be described with respect to only the subfield where the sustain pulse is not supplied in the sustain period.

The subfield where the sustain pulse is not supplied in the sustain period or the sustain period is not included is a low gray level subfield, and preferably may be the first subfield having the lowest gray level weight value and the second subfield having the second lowest gray level weight value. Further, although not illustrated, the bias voltages (Vzb1 and Vzb2) applied to the sustain electrode (Z) at the low gray level subfields (i.e., at the first subfield and the second subfield) are larger than in other subfields.

Here, as described above, at each of the subfields where the sustain pulse is not supplied in the sustain period or the sustain period is not included (i.e., at each of a plurality of low gray level subfields), a voltage difference between the scan electrode (Y) and the sustain electrode (Z) in the sustain period following the address period is less than the sustain voltage (Vs). In other words, when the sustain pulse is not supplied to any one of the scan electrode (Y) and the sustain electrode (Z) in the sustain period, or the sustain period is not included, then the voltage difference between the scan electrode (Y) and the sustain electrode (Z) is smaller than the sustain voltage (Vs) in the sustain period. Accordingly, at the low gray level subfield, the sustain discharge is not generated.

In FIG. 18, the sustain pulse supplied in the sustain period is omitted (or not applied) at the first and second subfields, the sustain pulse is not supplied to any one of the scan electrode (Y) and the sustain electrode (Z), and positive bias voltages (Vzb1, Vzb2) applied to the sustain electrode (Z) are larger than at other subfields, thereby embodying the lowest gray level.

In the driving waveform of FIG. 18, a pre-reset period may be additionally included prior to the reset period of the subfield having the lowest gray level weight value among the plurality of low gray level subfields. In other words, the pre-reset period may be provided in front of the reset period of the first subfield having the lowest gray level weight value.

The pre-reset period may be the same as the pre-reset periods of FIGS. 11*a* and 11*b* and therefore a further description of the pre-reset period will be omitted.

Further, in the set-up period of the reset period of the first subfield having a lower gray level-weight value among the plurality of low gray level subfields, the ramp-up pulse gradually increasing is applied to the scan electrode (Y). In the set-down period, the ramp-down pulse gradually decreasing from the positive voltage lower than a peak voltage of the ramp-up pulse is applied, and a voltage for constantly sustaining the voltage of the ground level (GND) in the set-up period or the set-down period where the ramp-down pulse supplied to the scan electrode (Y) is higher than the ground level (GND) is supplied to the sustain electrode (Z).

In the driving waveform of FIG. 18, the address period for selecting the on-discharge cell or the off-discharge cell from the discharge cells of the plasma display panel is provided after the reset period.

Meanwhile, at the first and second subfields of the driving waveform of FIG. 18, the bias voltages (Vzb1, Vzb2) applied to the sustain electrode (Z) in the address period and the set-down period of the reset period may be larger than at other subfields. This will be described below with reference to FIG. 19.

Figure 19:
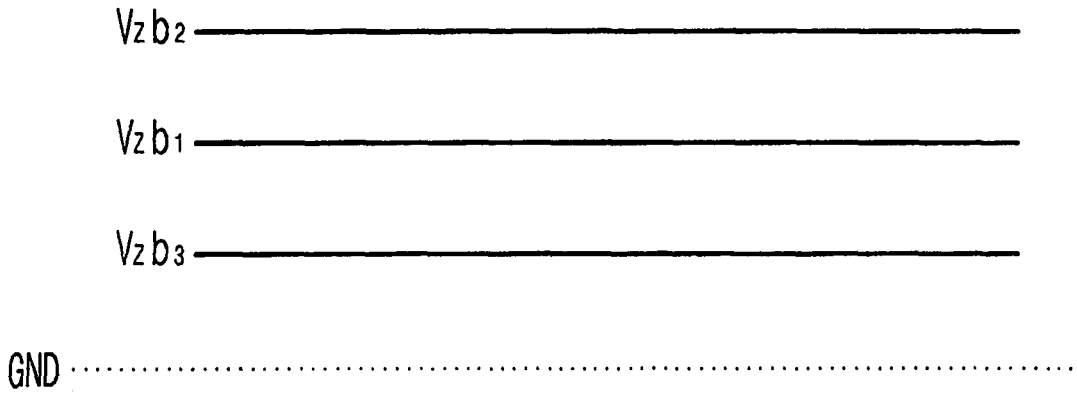
FIG. 19 illustrates bias voltages Vzb1, Vzb2 applied to sustain electrodes Z in the driving waveform of FIG. 18 according to an example embodiment of the present invention.

FIG. 19 illustrates bias voltages (Vzb1, Vzb2) applied to the sustain electrode (Z) in the driving waveform of FIG. 18 according to an example embodiment of the present invention. Other embodiments are also within the scope of the present invention.

In FIG. 19, the bias voltage (Vzb2) applied (or supplied) to the sustain electrode (Z) at the first subfield having the lowest gray level weight value and the second subfield having the second lowest gray level weight value among the subfields of the frame, is applied within the set-down period for supplying the set-down pulse and supplying the scan pulse to the scan electrode in the address period, and is larger than at other subfields (e.g, at the third to eighth subfields). More preferably, the bias voltages (Vzb1, Vzb2) applied to the sustain electrode (Z) at the first and second subfields are set to be less than 1.5 to 2.5 times of the bias voltage of the different subfield. For example, in case where a total of eight subfields constitute one frame, assuming that the bias voltage (Vzb2) of the different subfield (such as the second to eighth subfields) is 100 voltages, the bias voltages (Vzb1, Vzb2) are within 150 to 250 voltages at the first subfield having the lowest gray level weight value and the second subfield having the second lowest gray level weight value among the subfields of the frame.

Further, the bias voltages (Vzb1, Vzb2) at the first and second subfields (i.e., at the low gray level subfield where the sustain pulse is not supplied or the sustain period is not included) are set differently. For example, when the plurality of low gray lever subfields includes the first low gray level subfield and the second low gray level subfield (i.e., when the low gray level subfield where the sustain pulse is not supplied includes the first and second subfields as shown in FIG. 18), the bias voltage at the subfield having a larger gray level weight value from among the low gray level subfields may be larger than at other low gray level subfields. In other words, as shown in FIG. 18, the bias voltage (Vzb2) at the second subfield having the larger gray level weight value from among the first and second subfields being the low gray level subfields may be larger than the bias voltage (Vzb1) of the first subfield.

In the driving waveform of FIG. 18, any one of the bias voltage (Vzb1) supplied to the sustain electrode (Z) at the first subfield where the sustain pulse is not applied in the sustain period, and the bias voltage (Vzb2) applied to the sustain electrode (Z) at the second subfield where the sustain pulse is not supplied in the sustain period, is the sustain voltage (Vs). As such, one reason why the bias voltage (Vzb2) applied to the sustain electrode (Z) at the plurality of low gray level subfields (i.e., at the subfield having the larger gray level weight value among the subfields where the sustain pulse is not supplied in the sustain period or the sustain period is not included, for example, at the second subfield of FIG. 18) is larger than at the first subfield, is to generate a stronger address discharge at the second subfield than at the first subfield.

Accordingly, in the driving waveform of FIG. 18, the different small-number gray levels of less than 1 are embodied at the first and second subfield, thereby increasing the degree of the gray level expression at the low gray level, and reducing the half tone noise.

As such, the bias voltages (Vzb1, Vzb2) applied to the sustain electrode (Z) at the subfield where the sustain pulse is not supplied in the sustain period, or the sustain period is not included (e.g., at the first and second subfields of FIG. 18) are not only set to be larger than at other subfields, but also the difference between the scan reference voltage (Vsc) applied to the scan electrode (Y) in the address period and the bias voltages (Vzb1, Vzb2) applied to the sustain electrode (Z) are set to be larger than at other subfields. The difference between the scan reference voltage (Vsc) and the bias voltage (Vzb1, Vzb2) at the subfield where the sustain pulse is not supplied or the sustain period is not included may be more than 1.5 times greater than the sustain voltage (Vs). One reason why the difference between the scan reference voltage (Vsc) applied to the scan electrode (Y) in the address period and the bias voltages (Vzb1, Vzb2) applied to the sustain electrode (Z) is sustained larger than at other subfields is to generate the strong address discharge, thereby providing the light caused by the address discharge as enough as to express the gray-scale.

Further, a difference between the scan reference voltage (Vsc) and the bias voltage (Vzb1) at the first subfield (such as the lowest gray level subfield) and a difference between the scan reference voltage (Vsc) and the bias voltage (Vzb2) at the second subfield may be set differently. For example, assuming that the plurality of low gray level subfields includes the first low gray level subfield and the second low gray level subfield having the larger gray level weight value than that of the first low gray level subfield, the difference between the bias voltage (Vzb2) applied to the sustain electrode (Z) and the scan reference voltage (Vsc) applied to the scan electrode (Y) at the second low gray level subfield may be larger than at the first low gray level subfield. In other words, in FIG. 18, the difference between the bias voltage (Vzb2) applied to the sustain electrode (Z) and the scan reference voltage (Vsc) applied to the scan electrode (Y) at the second low gray level subfield may be larger than the difference between the bias voltage (Vzb1) applied to the sustain electrode (Z) and the scan reference voltage (Vsc) applied to the scan electrode (Y) at the first low gray level subfield.

In the sustain period of the driving waveform of FIG. 18, as in detail described in detail in FIGS. 11*a* and 11*b*, the sustain pulse is not supplied (or applied) to any one of the sustain electrode (Z) and the scan electrode (Y) at the plurality of low gray level subfields from among the subfields of the frame. The difference between the bias voltages (Vzb1, Vzb2) and the scan reference voltage (Vsc) sustained in the address period prior to the sustain period of the plurality of low gray level subfields is relative large and therefore, a self erase discharge may be generated in the beginning of the sustain period. In order to prevent the generation of the self erase discharge in the beginning of the sustain period, a self-erase prevention pulse (or signal or waveform) may be supplied in the sustain period following the address period of the plurality of low gray level subfield.

Further, even when the low gray level subfield does not include the sustain period, the self-erase prevention pulse may be supplied (or applied).

The self-erase prevention pulse may include the ramp-up pulse applied to the scan electrode (Y) and the pulse of the predetermined positive voltage applied to the sustain electrode (Z). More preferably, the self-erase prevention pulses applied at the plurality of low gray level subfields may all be the same or substantially the same. The self-erase prevention pulse may be substantially the same as the self-erase prevention pulses of FIGS. 11*a* and 11*b* and therefore a further description will be omitted.

Meanwhile, the sustain discharge is not generated at the subfield where the sustain pulse is not supplied in the sustain period or the sustain period is not included, from among the subfields of the frame. Therefore, an unstable discharge may occur at the sequential next subfield, thereby increasing a possibility of erroneous discharge, and reducing the driving margin at the further next subfield. In order to prevent the erroneous discharge and the reduction of the driving margin resulting from the characteristics of light emission of different phosphors, there may be a plurality of reset pulses (or signals or waveforms) at the next subfield sequential to the subfield where the sustain pulse is not supplied or the sustain period is not included. In other words, the low gray level subfield where the sustain pulse is not supplied or the sustain period is not included from among the subfields of the frame may be provided in plural and therefore the plurality of reset pulses are set and applied to the scan electrode in each of the reset periods of the plurality of low gray level subfields respectively sequential to and later in time than the plurality of low gray level subfields.

For example, as shown in FIG. 18, the plurality of reset pulses are supplied in the reset period of the second subfield sequential to and later in time than the first subfield, which is one of the subfields where the sustain pulse is not supplied in the sustain period from among the subfields of the frame. Furthers, the plurality of reset pulses may be applied in the reset period of the third subfield sequential to and later in time than the second subfield, which is one of the subfields where the sustain pulse is not supplied in the sustain period from among the subfields of the frame. In other words, the plurality of reset pulses may be applied to the scan electrode in the reset period at the second subfield sequential to the first subfield of the subfields of the frame, and the plurality of reset pulses may be applied to the scan electrode in the reset period even at the third subfield sequential to the second subfield.

As such, the reset pulses applied to the scan electrode in the reset period at all subfields sequential to and later than the plurality of low gray level subfields of the subfields of the frame (i.e., at the second and third subfields as shown in FIG. 18) may be set to be the same in number. For example, as shown in FIG. 18, two reset pulses (or signals or waveforms) are respectively applied in the reset period at each of the second and third subfields.

As such, as shown in FIG. 18, when the plurality of reset pulses are applied at the next subfield sequential to the subfield where the sustain pulse is not supplied or the sustain period is not included, the reset period may include the first reset period and the second reset period for supplying the reset pulse to the scan electrode at the second subfield sequential to the first subfield of the subfields of the frame, and includes the first reset period and the second reset period for supplying the reset pulse to the scan electrode even at the third subfield sequential to the second subfield. In other words, when the low gray level subfield (i.e., where the sustain pulse is not supplied in the sustain period or the sustain period is not included) includes two subfields, the two low gray level subfields include the first low gray level subfield (i.e., the first subfield of FIG. 18) and the second low gray level subfield (i.e., the second subfield of FIG. 18) that is sequential to and later in time and has the larger gray level weight value than the first low gray level subfield, and the reset period includes the first reset period and the second reset period for supplying the reset pulse by one to the scan electrode at the second low gray level subfield and its next subfield sequential to and later in time than the second low gray level subfield.

In the first reset period, a pulse may be applied to the scan electrode (Y) that gradually increases from the ground level (GND) as a ramp-up pulse and decreases from the end of the ramp-up pulse to the ground level (GND). Additionally, the pulse for sustaining the voltage of the ground level (GND) may be applied to the sustain electrode (Z).

Further, in the second reset period, a pulse may be supplied to the scan electrode (Y) that gradually increases from the ground level (GND) as a ramp-up pulse that decreases from the end of the ramp-up pulse to the ground level (GND), and then gradually decreases as a ramp-down pulse. Additionally, a pulse for sustaining the voltage of the ground level (GND) may be applied to the sustain electrode (Z).

The wall charge inversion period for inverting the distribution of the wall charge within the discharge cell in the first reset period may be additionally included between the first reset period and the second reset period. In other words, as shown in FIG. 18, the wall charge inversion period may be included between the first reset period and the second reset period of the reset period of the second subfield, and the wall charge inversion period is additionally included between the first reset period and the second reset period of the reset period of the third subfield.

In the wall charge inversion period, as shown in FIG. 18, the ramp-down pulse (or signal or waveform) gradually decreasing from the ground level (GND) is applied to the scan electrode (Y), and the pulse for sustaining the predetermined positive voltage is supplied to the sustain electrode (Z) Here, the positive voltage may be the sustain voltage (Vs). The wall charge inversion period of FIG. 18 may be substantially the same as the wall charge inversion periods of FIGS. 11*a* and 11*b* and therefore a duplicate description will be omitted.

The driving methods of the plasma display panels according to the first and second embodiments of the present invention relate to cases where when the plurality of reset pulses are included in the reset period, two reset pulses are included in one reset period. However, three or more reset pulses may be included in one reset period. This will be described below in a driving method of a plasma display panel according to a third embodiment of the present invention.

Figure 20:
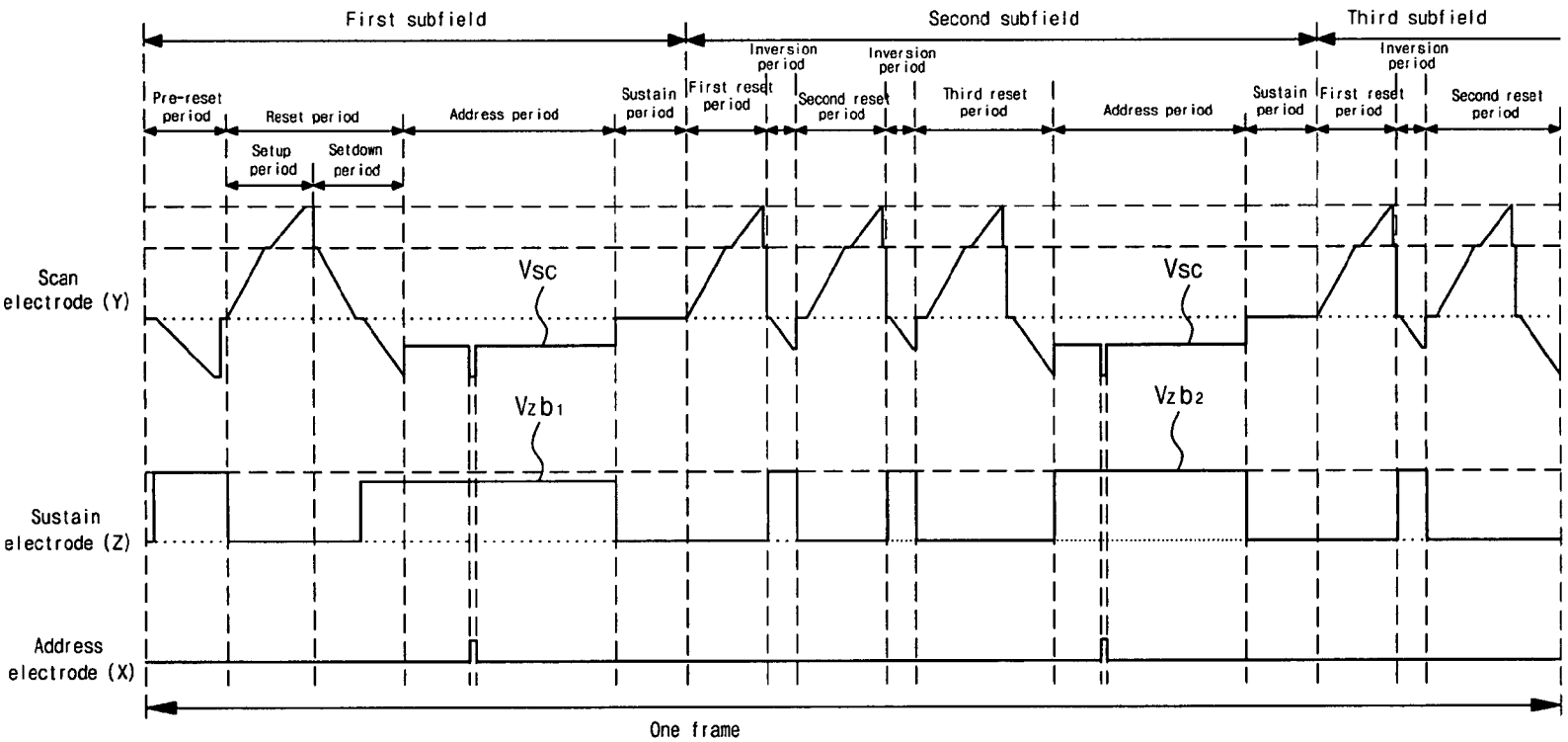
FIG. 20 illustrates a driving method of a plasma display apparatus according to a third embodiment of the present invention.

FIG. 20 illustrates a driving method of the plasma display panel according to the third embodiment of a present invention. Other embodiments are also within the scope of the present invention.

Referring to FIG. 20, in the driving method, the low gray level subfield, where the sustain pulse is not supplied in the sustain period or the sustain period is not included, may be provided in plural in number within one frame, and the reset pulse applied to the scan electrode in the reset period of the plurality of subfields sequential to and later in time than the plurality of low gray level subfields is set differently in number at one or more subfields. In the driving method of the plasma display panel according to the third embodiment, the low gray level subfield is the subfield where the sustain pulse is not supplied in the sustain period or the sustain period is not included. However, for ease of description, only the low gray level subfield where sustain pulse is not supplied in the sustain period will be described.

For example, as shown in FIG. 20, the sustain pulse is not applied to any one of the scan electrode (Y) and the sustain electrode (Z) in the sustain period at the first subfield and the second subfield of the frame. In other words, the first and second subfields are the low gray level subfields and the sustain pulses applied to the sustain electrode in the sustain period of the first and second subfields are different from other subfields. Further, the number of the reset pulses applied in the reset period of the second subfield sequential to and later in time than the first subfield is different from the number of the reset pulses applied in the reset period at the third subfield sequential to and later in time than the second subfield. Preferably, a total of three reset pulses may be applied in the reset period of the second subfield sequential to and later in time than the first subfield, which is the low gray level subfield where the sustain pulse is not supplied in the sustain period or the sustain period is not included, and a total of two reset pulses may be applied in the reset period of the third subfield sequential to and later in time than the second subfield.

Reset pulses may be set in different numbers in the reset period of the second subfield and the reset period of the third subfield. For example, three reset pulses may be set in the reset period of the second subfield and two reset pulses may be set in the reset period of the third subfield. As described above, one reason is that since the bias voltage (Vzb1) supplied to the sustain electrode (Z) at the first subfield is smaller than the bias voltage (Vzb2) applied to the sustain electrode (Z) at the second subfield, the discharge at the second subfield sequential to the first subfield has a great possibility of being more unstable than at the third subfield sequential to the second subfield. Accordingly, the number of the reset pulses is increased at the second subfield, thereby setting the reset pulses to be, for example, three and so as to stabilize the discharge.

In the driving methods of the plasma display panels according to the first to third embodiments of the present invention, the bias voltage (Vzb) applied to the sustain electrode (Z) in the address period at the subfield where the sustain pulse is not supplied to any one of scan electrode (Y) and the sustain electrode (Z) in the sustain period, or the sustain period is not included from among the subfields of the frame may be set to be larger than at other subfields, thereby setting the voltage difference between the scan electrode (Y) and the sustain electrode (Z) in the address period to be larger than at other subfields. Accordingly, the address discharge generated in the address period is set to be larger than at other subfields. Unlike this, the scan reference voltage (Vsc) applied to the scan electrode (Y) in the address period at the subfield where the sustain pulse is not supplied to any one of the scan electrode (Y) and the sustain electrode (Z) in the sustain period or the sustain period is not included from among the subfields of the frame is set to be smaller than at other subfields, thereby setting the voltage difference between the scan electrode (Y) and the address electrode (X) in the address period to be larger than at other subfields in the address period so that the address discharge generated in the address period can be set to be larger than at other subfields. This will be described below with reference to FIG. 21.

Figure 21:
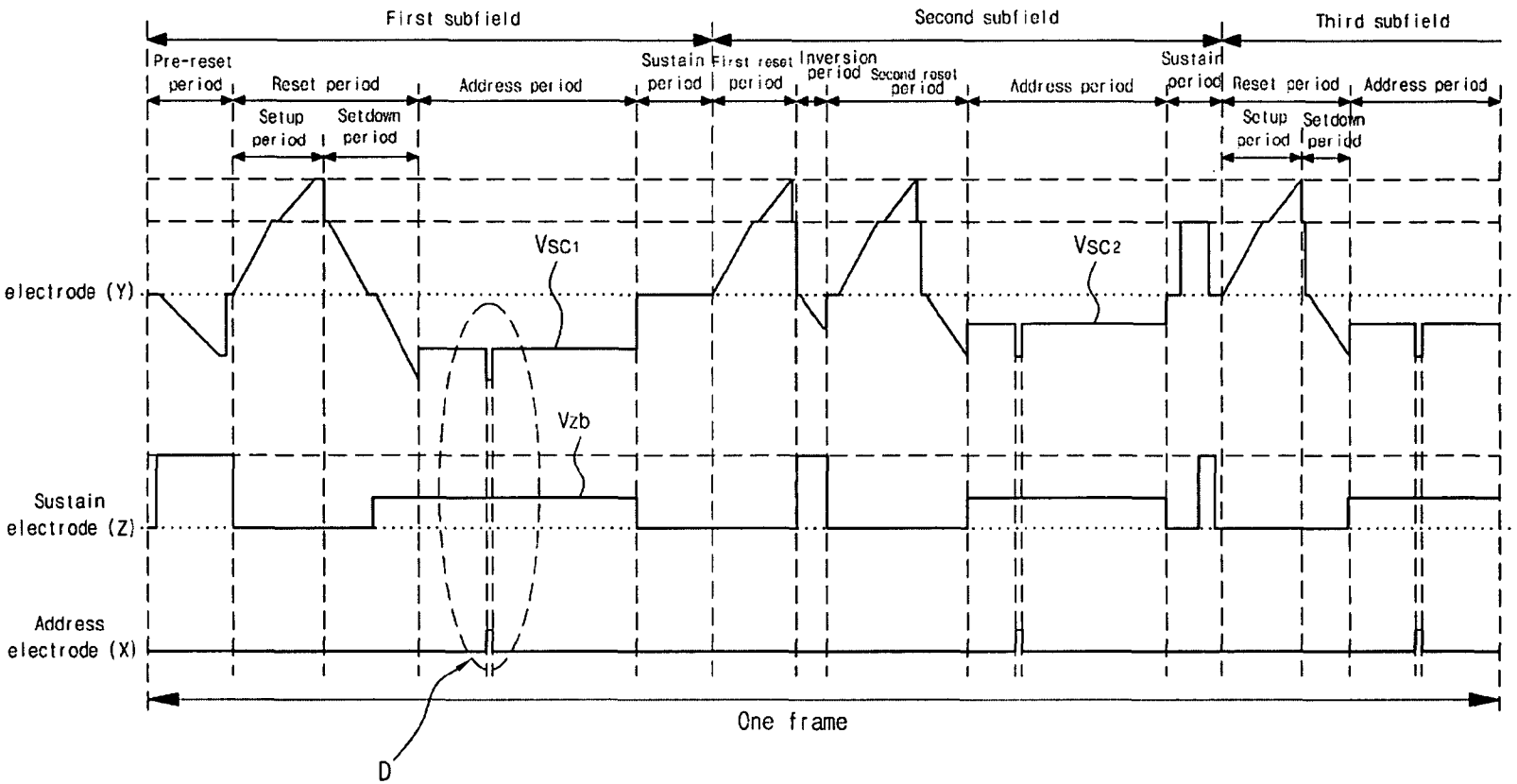
FIG. 21 illustrates a driving method of a plasma display apparatus according to a fourth embodiment of the present invention.

FIG. 21 illustrates a driving method of a plasma display panel according to a fourth embodiment of the present invention. Other embodiments area also within the scope of the present invention.

In FIG. 21, at the low gray level subfield of the subfields of the frame, the sustain pulse is not supplied to even any one of the scan electrode (Y) and the sustain electrode (Z) in the sustain period or the sustain period is not included, and also, the scan reference voltage (Vsc1) supplied to the scan electrode (Y) is smaller than the scan reference voltage (Vsc2) at another subfield.

Accordingly, the voltage difference between the scan electrode (Y) and the address electrode (X) becomes larger than at other subfields in the address period. As a result, the address discharge generated from a region D of the address period becomes larger than at other subfields.

The driving method of the plasma display panel according to the fourth embodiment of the present invention is the same as the driving methods of the plasma display panel according to the first to third embodiments, except that the scan reference voltage (Vsc1) applied to the scan electrode (Y) in the address period becomes smaller than the scan reference voltage (Vsc2) at another subfield so as to allow the address discharge generated in the address period to be larger than at other subfields. Therefore, a further description will be omitted.

Similarly with the driving methods of the plasma display panels according to the first to third embodiments, even in the driving method of the plasma display panel according to the fourth embodiment, the generation of the half tone noise where the images are spread at their boundary is reduce d. Accordingly, a larger definition of image can be embodied.

Meanwhile, unlike the driving methods of the plasma display panels according to the first to fourth embodiments of the present invention, the voltage of the scan pulse (−Vy) applied to the scan electrode (Y) in the address period may be larger than at other subfields so as to set the address discharge generated in the address period to be larger than at other subfields. This will be described below with reference to FIG. 22.

Figure 22:
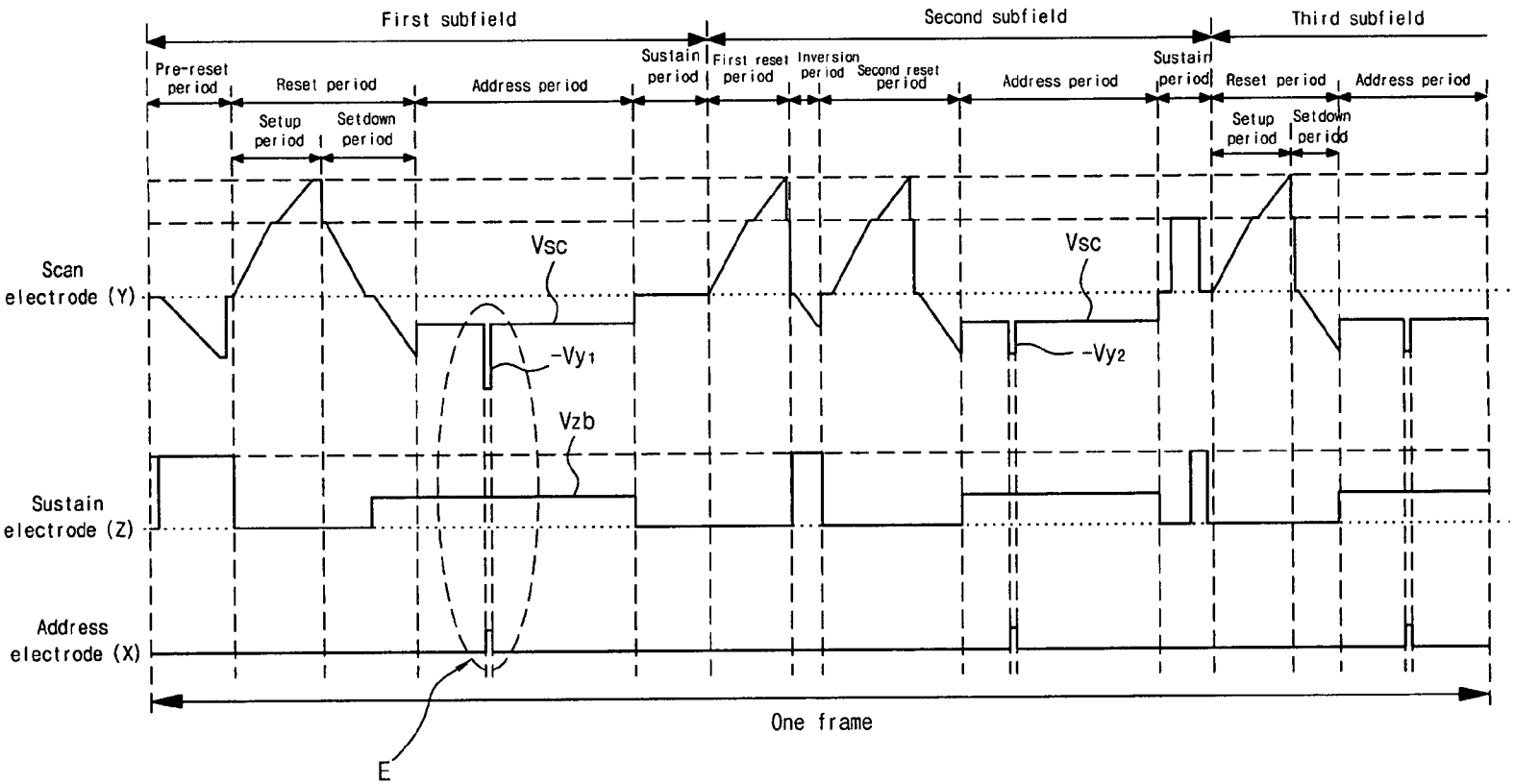
FIG. 22 illustrates a driving method of a plasma display apparatus according to a fifth embodiment of the present invention.

FIG. 22 illustrates a driving method of a plasma display panel according to a fifth embodiment of the present invention. Other embodiments are also within the scope of the present invention.

In FIG. 22, at the low gray level subfield of the subfields of the frame, the sustain pulse is not supplied to even any one of the scan electrode (Y) and the sustain electrode (Z) in the sustain period or the sustain period is not included, and also the scan pulse (−Vy1) supplied to the scan electrode (Y) is larger than the scan pulse (−Vy2) at another subfield.

Accordingly, the voltage difference between the scan electrode (Y) and the address electrode (X) becomes larger than at other subfields in the address period. As a result, the address discharge generated from a region E of the address period becomes larger than at other subfields.

The driving method of the plasma display panel according to the fifth embodiment of the present invention is the same as the driving methods of the plasma display panel according to the first to fourth embodiments except that the scan pulse (−Vy1) applied to the scan electrode (Y) in the address period becomes larger than the scan pulse (−Vy2) at another subfield so as to allow the address discharge generated in the address period to be larger than at other subfields. Therefore, a further description will be omitted.

Similarly with the driving methods of the plasma display panels according to the first to fourth embodiments, even in the driving method of the plasma display panel according to the fifth embodiment, the generation of the half tone noise where the images are spread at their boundary may be reduced. Accordingly, a larger definition of image can be embodied.

Meanwhile, unlike the driving methods of the plasma display panels according to the first to fifth embodiments of the present invention, the voltage of the data pulse (Vd) applied to the address electrode (X) in the address period may be set to be larger than at other subfields so that it is possible to also set the address discharge generated in the address period to be larger than at other subfields. This will be described below with reference to FIG. 23.

Figure 23:
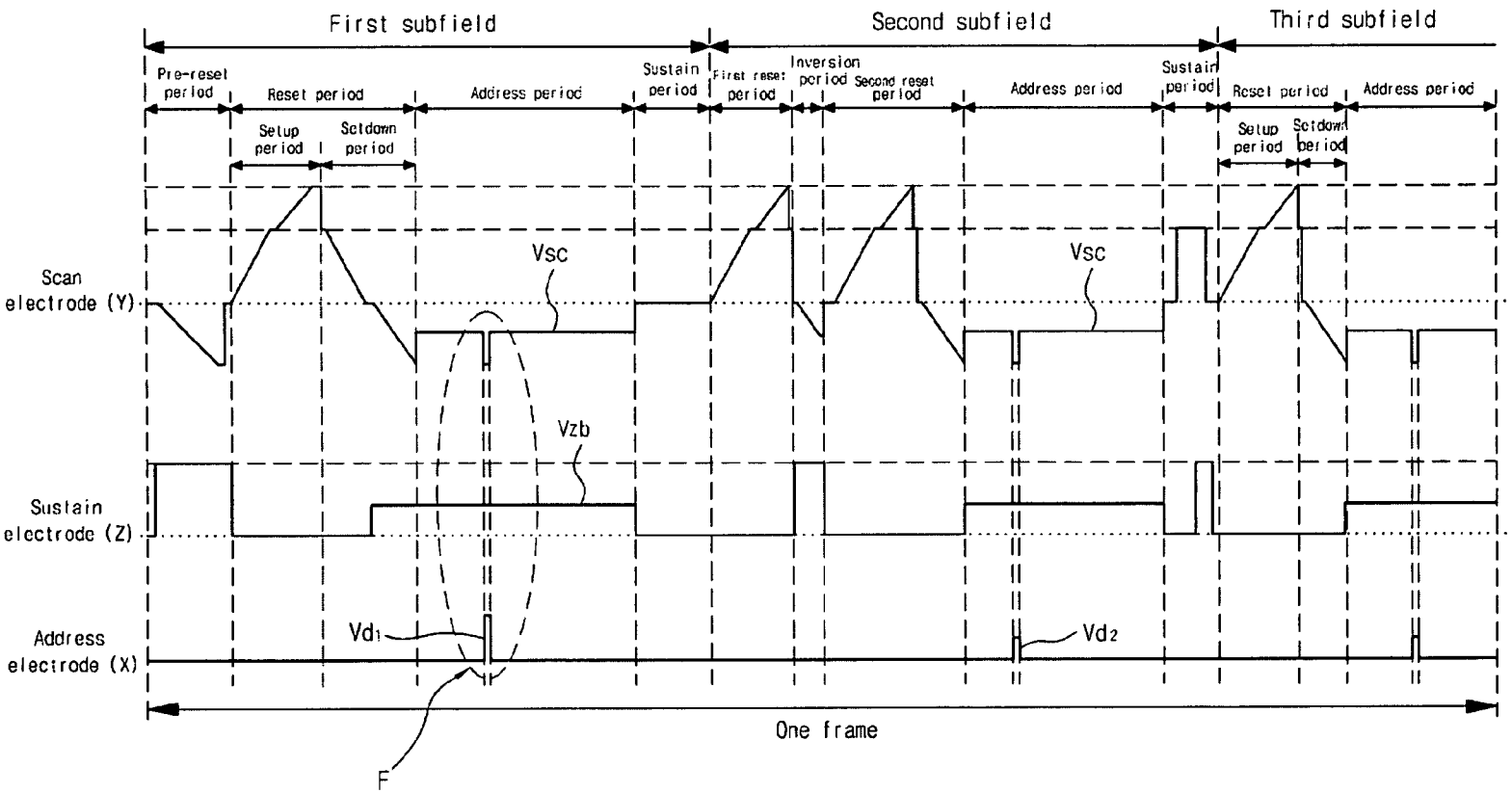
FIG. 23 illustrates a driving method of a plasma display apparatus according to a sixth embodiment of the present invention.

FIG. 23 illustrates a driving method of a plasma display panel according to a sixth embodiment of the present invention. Other embodiments are also within the scope of the present invention.

In FIG. 23, at the low gray level subfield of the subfields of the frame, the sustain pulse is not supplied to even any one of the scan electrode (Y) and the sustain electrode (Z) in the sustain period or the sustain period is not included, and also the data pulse (Vd1) applied to the address electrode (X) is larger than the data pulse (Vd2) at another subfield.

Accordingly, the voltage difference between the scan electrode (Y) and the address electrode (X) becomes larger than at other subfields in the address period. As a result, the address discharge generated from a region F of the address period becomes larger than at other subfields.

The driving method of the plasma display panel according to the sixth embodiment of the present invention is the same as the driving methods of the plasma display panel according to the first to fifth embodiments, except that the data pulse (Vd1) applied to the address electrode (X) in the address period becomes larger than the data pulse (Vd2) at another subfield so as to allow the address discharge generated in the address period to be larger than at other subfields. Therefore, a further description will be omitted.

Similarly with the driving methods of the plasma display panels according to the first to fifth embodiments, even in the driving method of the plasma display panel according to the sixth embodiment, the generation of the half tone noise where the images are spread at their boundary is reduced. Accordingly, the larger definition of image can be embodied.

Meanwhile, the driving methods of the plasma display panels according to the first to sixth embodiments of the present invention illustrate and describe a case that the reset pulse applied to the scan electrode (Y) in the reset period at all subfields are set to all be the same. However, it may be desirable that the reset pulse applied to the scan electrode (Y) in the reset period at one low gray level subfield having the lowest gray level weight value from among the plurality of subfields may be set to be larger than at other subfields, so that it is possible to also set the address discharge generated in the address period to be larger than at other subfields. This will be described below with reference to FIG. 24.

Figure 24:
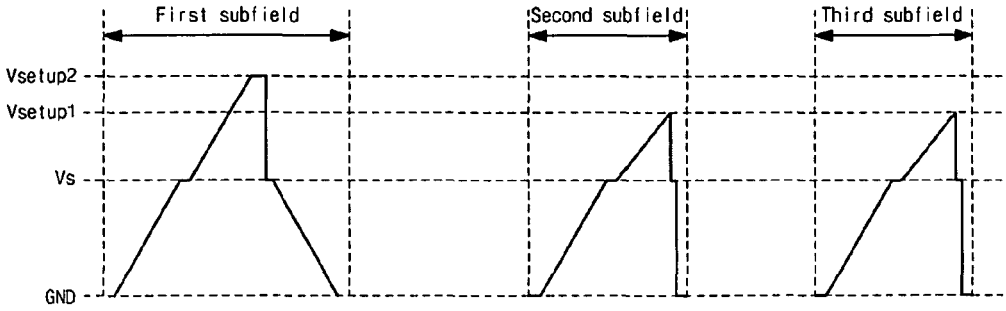
FIG. 24 is a view for showing a width of a reset pulse according to an example embodiment of the present invention, wherein a width of a reset pulse applied in a reset period of a subfield with the lowest gray level weight among a plurality of subfields is greater than any reset pulses applied in the other subfields.

FIG. 24 illustrates an example embodiment of a method for setting the reset pulse applied in the reset period of one subfield having the lowest gray level weight value from among the plurality of subfields to be larger than at other subfields.

In FIG. 24, a set-up voltage (Vset-up1) of the reset pulse applied to the scan electrode (Y) in the reset period at one subfield having the lowest gray level weight value from among the subfield of the frame is larger than a set-up voltage (Vset-up2) applied to the scan electrode (Y) in the reset period of another subfield.

For example, as shown in FIG. 11, the reset pulse applied in the reset period at the first subfield is larger than at other subfields.

In the driving method of the plasma display panel according to the second embodiment of the present invention shown in FIG. 18, the reset pulse applied in the reset period of the subfield, where the sustain pulse is not supplied to even any one of the scan electrode (Y) and the sustain electrode (Z) in the sustain period, or the sustain period is not included (i.e., the first subfield having the lowest gray level weight value among the low gray level subfields) may be larger than at other subfields.

The set-up voltage (Vset-up1) of the reset pulse of the subfield where the sustain pulse is not supplied in the sustain period, or the sustain period is not included (i.e., the low gray level subfield), or the set-up voltage (Vset-up2) of the reset pulse of the low gray level subfield having the lowest gray level weight value from among the plurality of low gray level subfields may be set to be larger than at other subfields. One reason is that since the sustain pulse is not supplied in the sustain period at the low grayscale subfield, a possibility of unstabilizing the discharge at the low gray level subfield becomes large. Accordingly, the reset pulse is set at the low gray level subfield to be larger than at other subfields, thereby stabilizing the discharge.

As described above, in the plasma display apparatus and its driving method, the sustain pulse is not supplied in the sustain period, or the sustain period is not included, at one or more low gray level subfields of the plurality of subfields of the frame. Additionally, the discharge is stabilized at the low gray level subfield, thereby making it possible to apply a single scan driving method for sequentially addressing all discharge cells of one plasma display panel.

A plasma display apparatus in accordance with an example embodiment of the present invention may include a plasma display panel having a plurality of scan electrodes, a plurality of scan electrodes, and a plurality of address electrodes arranged to intersect the scan electrodes and the sustain electrodes. The plasma display panel may also include a driving part for driving the scan electrodes, the sustain electrodes and the address electrodes, and a driving pulse control unit for controlling the driving unit to allow a voltage difference between the scan electrode and the sustain electrode or a voltage difference between the scan electrode and the address electrode during an address period of at least one subfield of a frame to be larger than a voltage difference between the scan electrode and the sustain electrode or a voltage difference between the scan electrode and the address electrode during the address period another subfield of the frame.

The driving pulse control unit may control the at least one subfield so as to exclude a sustain period (i.e., so as to not include a sustain period). The driving pulse control unit may control the driving unit so as to exclude a sustain pulse (or signal or waveform) during any sustain period of the at least one subfield.

The at least one subfield may be one subfield from among a first low gray level subfield to a third low gray subfield of the frame.

The driving pulse control unit may control a magnitude of a reset pulse (or signal or waveform) applied in a reset period of the subfield having the lowest gray level weight value among the low gray level subfields to be larger than that of a reset pulse (or signal or waveform) applied in a reset period of the other subfields.

The driving pulse control unit may control the subfield having the lowest gray level weight value among the low gray level subfields to include a pre-reset period prior to the reset period of the subfield.

In the pre-reset period, the driving pulse control unit applies a gradually decreasing waveform (or gradually failing waveform) to the scan electrode and applies a waveform sustaining (or maintaining) a predetermined positive voltage to the sustain electrode.

The positive voltage may be a sustain voltage (Vs).

The driving pulse control unit may apply a gradually increasing waveform (or gradually rising waveform) to the scan electrode in a set-up period of the reset period of the low gray level subfield, and apply a decreasing waveform that gradually decreases from a positive voltage lower than a peak voltage of the rising waveform in a set-down period, while the driving pulse control unit applies a voltage constantly sustaining a voltage of ground level (GND) to the sustain electrode, during the period where a voltage of the decreasing waveform supplied to the scan electrode is higher than the ground level (GND) in the set-up period or the set-down period.

The driving pulse control unit may apply a bias voltage to the scan electrode within the set-down period where a set-down pulse (or signal or waveform) is applied and the address period where a scan pulse (or signal or waveform) is applied, wherein the bias voltage is applied to the sustain electrode during a first subfield of the low gray level subfields.

The driving pulse control unit may control the bias voltage to be 1.5 to 2.5 times greater than the bias voltage of the other subfields, wherein the bias voltage is applied to the sustain electrode during the first subfield of the low gray level subfields.

The driving pulse control unit may control the bias voltage to be 150 to 400 V, wherein the bias voltage is applied to the sustain electrode during the first subfield of the low gray level subfields.

The driving pulse control unit may control a bias voltage to be a sustain voltage (Vs), wherein the bias voltage is applied to the sustain electrode in one of the low gray level subfields.

The driving pulse control unit may control the low gray level subfields to include a first low gray level subfield and a second low gray level subfield having a larger gray level weight value than that of the first low gray level subfield, wherein a bias voltage, in the second low gray level subfield, applied to the sustain electrode, is larger than that of the first low gray level subfield.

The driving pulse control unit may control a voltage difference between a bias voltage applied to the sustain electrode and a scan reference voltage (Vsc) applied to the scan electrode during the low gray level subfield to be larger than that of other subfields.

The driving pulse control unit may control the voltage difference between the bias voltage applied to the sustain electrode and the scan reference voltage (Vsc) applied to the scan electrode during the low gray level subfield to be 1.5 times greater than the sustain voltage (Vs).

The driving pulse control unit may control the voltage difference between the bias voltage applied to the sustain electrode and the scan reference voltage (Vsc) applied to the scan electrode during the low gray level subfield to be more than 250 V.

The driving pulse control unit may control the low gray level subfield to include a first low gray level subfield and a second low gray level subfield having a larger gray level weight value than that of the first low gray level subfield, wherein a voltage difference between a bias voltage applied to the sustain electrode and a scan reference voltage (Vsc) applied to the scan electrode in the second low gray level subfield is larger than that of the first low gray level subfield.

The driving pulse control unit may supply a self-erase prevention pulse (or signal or waveform) after a data pulse (or signal or waveform) is applied in the low gray level subfield, and before a rising waveform is applied in a reset period in the next subfield.

The driving pulse control unit may control the self-erase prevention waveform (or pulse or signal) applied at the low gray level subfield to include an increasing waveform applied to the scan electrode and a waveform (or pulse or signal) of a predetermined positive voltage applied to the sustain electrode.

The driving pulse control unit controls each of the self-erase prevention waveforms supplied at the low grayscale subfield to be the same.

The driving pulse control unit may control the positive voltage of the self-erase prevention waveform to be larger than the voltage of a ground level (GND) and to be smaller than a sustain voltage (Vs).

The driving pulse control unit may control the positive voltage to be half of the bias voltage applied to the sustain electrode in the first subfield.

The driving pulse control unit may apply a plurality of reset pulses (or signal or waveform) to scan electrode in each reset period in a subfield, wherein the subfield is sequential to and later in time than any one low gray level subfield of the subfields of the frame.

The driving pulse control unit may control the number of the reset pulses applied to the scan electrode in the reset period in the plurality of subfields to be different in one or more subfields, wherein the plurality of subfields are sequential to and later in time than any one low gray level subfield of the subfields of the frame.

The driving pulse control unit may control the number of the reset pulses applied to the scan electrode in the reset period in all subfields to be the same, wherein the subfields are sequential to and later in time than any one low gray level subfield of the subfields of the frame.

The driving pulse control unit may control the reset period to include a first reset period and a second reset period to apply one reset pulse (or signal or waveform) to the scan electrode respectively in the subfield, wherein the subfield is sequential to and later in time than any one low gray level subfield of the subfields of the frame.

The first reset period, wherein the driving pulse control unit applies a waveform, which gradually increases from a ground level (GND) and decreases from the peak of the rising waveform to the ground level (GND), to the scan electrode, while the driving pulse control unit applies a pulse (or signal or waveform) sustaining a voltage of the ground level (GND) to the sustain electrode.

The second reset period, wherein the driving pulse control unit applies a waveform, which gradually increases from a ground level (GND) and decreases from the peak of the rising waveform to the ground level (GND) and then gradually decreases, to the scan electrode, while the driving pulse control unit applies a pulse (or signal or waveform) sustaining a voltage of the ground level (GND) to the sustain electrode.

The first reset period and the second reset period, wherein the driving pulse control unit controls the first reset period and the second reset period to include a wall charge inversion period for inverting a distribution of a wall charge within a discharge cell in the first reset period.

The driving pulse control unit, in the wall charge inversion period, applies a falling pulse (or signal or waveform) gradually decreasing from a ground level (GND) to the scan electrode, and applies a pulse (or signal or waveform) sustaining a predetermined positive voltage to the sustain electrode.

The positive voltage is a sustain voltage (Vs).

The driving pulse control unit controls a scan reference voltage (Vsc) applied to the scan electrode in the low gray level subfield of the subfields of the frame to be smaller than a scan reference voltage supplied to the scan electrode in other subfields.

The driving pulse control unit controls a negative scan pulse (−Vy) (or signal or waveform) applied to the scan electrode in the low gray level subfield of the subfields of the frame to be larger than a negative scan pulse (−Vy) (or signal or waveform) applied to the scan electrode in other subfields.

The driving pulse control unit controls a magnitude of a data pulse (or signal or waveform) applied to the address electrode in the low gray level subfield of the subfields of the frame to be larger than that of a data pulse (or signal or waveform) applied to the address electrode in other subfields.

A driving method is also provided for a plasma display panel having a scan electrode and a sustain electrode, and an address electrode formed to intersect with the scan electrode and the sustain electrode. A voltage difference between the scan electrode and the sustain electrode or a voltage difference between the scan electrode and the address electrode during an address period in at least one subfield of a frame may be larger than a voltage difference between the scan electrode and the sustain electrode or a voltage difference between the scan electrode and the address electrode during the address period in other subfields.

The at least one subfield does not include a sustain period or is a low gray level subfield where a sustain pulse (or signal or waveform) is not applied in the sustain period.

The low gray level subfield is at least one subfield among subfields from a first subfield having the lowest gray level weight value to a third subfield.

A magnitude of a reset pulse (or signal or waveform) applied in a reset period of the subfield having the lowest gray level weight value among the low gray level subfields may be larger than that of a reset pulse (or signal or waveform) applied in a reset period of the other subfield.

The subfield having the lowest gray level weight value among the low gray level subfields may include a pre-reset period prior to the reset period.

In the pre-reset period, a gradually falling waveform (or gradually decreasing waveform) is applied to the scan electrode, and a waveform for sustaining a predetermined positive voltage is applied to the sustain electrode.

The positive voltage may be a sustain voltage (Vs).

A gradually rising waveform (or gradually increasing waveform) is applied to the scan electrode in a set-up period of the reset period of the low grayscale subfield, and a falling waveform (or decreasing waveform) gradually decreasing from a positive voltage lower than a peak voltage of the rising waveform is applied to the scan electrode in a set-down period, while a voltage constantly sustaining a voltage of ground level (GND) is applied to the sustain electrode, during the period where a voltage of the falling waveform applied to the scan electrode is higher than the ground level (GND) in the set-up period or the set-down period.

A bias voltage applied to the sustain electrode at a first subfield of the low gray level subfields is applied within the set-down period where a set-down pulse (or signal or waveform) is applied and the address period where a scan pulse (or signal or waveform) is applied to the scan electrode.

The bias voltage applied to the sustain electrode in the first subfield of the low gray level subfields may be 1.5 to 2.5 times of the bias voltage of the other subfield.

The bias voltage applied to the sustain electrode in the first subfield of the low gray level subfields may be 150 to 400 voltages.

The bias voltage applied to the sustain electrode in one of the low gray level subfields may be a sustain voltage (Vs).

The low gray level subfield may include a first low gray level subfield and a second low gray level subfield having a larger gray level weight value than the first low grayscale subfield, and a bias voltage applied to the sustain electrode in the second low gray level subfield may be larger than that of the first low gray level subfield.

A voltage difference between a bias voltage applied to the sustain electrode and a scan reference voltage (Vsc) applied to the scan electrode in the low gray level subfield may be set to be larger than in other subfields.

The voltage difference between the bias voltage applied to the sustain electrode and the scan reference voltage (Vsc) applied to the scan electrode in the low gray level subfield may be 1.5 times greater than a sustain voltage (Vs).

The difference between the bias voltage applied to the sustain electrode and the scan reference voltage (Vsc) applied to the scan electrode at the low gray level subfield may be more than 250 V.

The low gray level subfield may include a first low gray level subfield and a second low gray level subfield having a larger gray level weight value than the first low gray level subfield, while a voltage difference between a bias voltage applied to the sustain electrode and a scan reference voltage (Vsc) applied to the scan electrode in the second low gray level subfield may be larger than that of the first low gray level subfield.

A self-erase prevention waveform (or pulse or signal) is applied, after a data pulse (or signal or waveform) is applied in the low gray level subfield, and before a rising waveform is applied in a reset period in the next subfield.

The self-erase prevention waveform applied in the low gray level subfield may include a rising waveform supplied to the scan electrode and a waveform (or pulse or signal) of a predetermined positive voltage applied to the sustain electrode.

Each of the self-erase prevention waveforms applied in the low gray level subfield may be all the same.

A positive voltage of the self-erase prevention waveform may be larger than ground level (GND) and may be smaller than a sustain voltage (Vs).

The positive voltage may be half of the bias voltage applied to the sustain electrode in the first subfield.

A plurality of reset pulses (or signals or waveforms) may be applied to the scan electrode in each reset period in a subfield, wherein the subfield is sequential to and later in time than any one low gray level subfield of the subfields of the frame.

The number of the reset pulses applied to the scan electrode in the reset period in the plurality of subfields may be different in one or more subfields, wherein the plurality of subfields are sequential to and later in time than any one low gray level subfield of the subfields of the frame.

The number of the reset pulses applied to the scan electrode in the reset period in all subfields may be the same, wherein the subfields are sequential to and later in time than any one low gray level subfield of the subfields of the frame.

The reset period may include a first reset period and a second reset period to apply one reset pulse (or signal or waveform) to the scan electrode respectively in the subfields, wherein the subfields are sequential to and later in time than any one low gray level subfield of the subfields of the frame.

During the first reset period, a waveform, which gradually increases from a ground level (GND) and decreases from the peak of the rising waveform to the ground level (GND), may be applied to the scan electrode, and a pulse (or signal or waveform) sustaining a voltage of the ground level (GND) may be applied to the sustain electrode.

During the second reset period, a waveform is applied to the scan electrode to gradually increase from a ground level (GND), decrease from the peak of the rising waveform to the ground level (GND) and then gradually decreases as a falling waveform, while a pulse sustaining a voltage of the ground level (GND) is applied to the sustain electrode.

A wall charge inversion period for inverting a distribution of a wall charge within a discharge cell in the first reset period may be included between the first reset period and the second reset period.

A falling pulse gradually decreasing from the ground level (GND) is applied to the scan electrode, and a pulse sustaining a predetermined positive voltage is applied to the sustain electrode.

The positive voltage may be a sustain voltage (Vs).

A scan reference voltage (Vsc) applied to the scan electrode in the low gray level subfield of the subfields of the frame may be smaller than a scan reference voltage supplied to the scan electrode in other subfields.

A negative scan pulse (−Vy) supplied to the scan electrode in the low gray level subfield of the subfields of the frame may be larger than a negative scan pulse (−Vy) applied to the scan electrode in other subfields.

A voltage of a data pulse (or signal or waveform) applied to the address electrode in the low gray level subfield of the subfields of the frame may be larger than a voltage of a data pulse applied to the address electrode in other subfields.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display apparatus, comprising:

a plasma display panel having a scan electrode and a sustain electrode, and an address electrode formed to intersect with the scan electrode and the sustain electrode; and a driving unit for providing a voltage difference between the scan electrode and the sustain electrode during an address period of at least one subfield of a frame to be larger than a voltage difference between the scan electrode and the sustain electrode during the address period in another subfield of the frame, wherein the another subfield is provided right after the at least one subfield in time, and wherein the driving unit controls the at least one subfield so as to exclude a sustain period in the at least one subfield or to exclude a sustain waveform during any sustain period of the at least one subfield, and the another subfield so as to include a sustain waveform during a sustain period of the another subfield, wherein the at least one subfield comprises a low gray level subfield having a lowest gray weight value among first, second and third low gray level subfields of the frame, and the at least one subfield and the another subfield is included in the same frame.

2. The apparatus of claim 1, wherein the driving unit controls a magnitude of the reset waveform applied in a reset period of the at least one subfield having the lowest gray level weight value such that the magnitude of the reset waveform is larger than a magnitude of a reset waveform applied in a reset period of the another subfield of the frame.

3. The apparatus of claim 1, wherein the driving unit controls the at least one subfield having the lowest gray level weight value so as to include a pre-reset period prior to a reset period of the at least one subfield.

4. The apparatus of claim 3, wherein the driving unit applies a decreasing waveform to the scan electrode in the pre-set period and applies a waveform sustaining a predetermined positive voltage to the sustain electrode in the pre-reset period.

5. The apparatus of claim 4, wherein the positive voltage comprises a sustain voltage.

6. The apparatus of claim 1, wherein the driving unit applies an increasing waveform to the scan electrode in a set-up period of a reset period, and the driving unit applies a decreasing waveform decreasing from a positive voltage lower than a peak voltage of the increasing waveform in a set-down period of the reset period, the driving unit also applying a preset voltage to the sustain electrode during a time period when a voltage of the decreasing waveform applied to the scan electrode is higher than the preset voltage in the set-up period or the set-down period.

7. The apparatus of claim 6, wherein the preset voltage comprises a substantially ground voltage.

8. The apparatus of claim 1, wherein the driving unit applies a bias voltage to the sustain electrode within a set-down period of a reset period when a set-down waveform is applied and within the address period when a scan waveform is applied, wherein the bias voltage is applied to the sustain electrode during a first subfield of the first, second and third low gray level sub fields.

9. The apparatus of claim 8, wherein the driving unit controls the bias voltage in the at least one subfield to be 1.5 to 2.5 times greater than the bias voltage of the another subfield, wherein a bias voltage of the at least one subfield is applied to the sustain electrode during the first subfield of the first, second and third low gray level subfields.

10. The apparatus of claim 9, wherein the driving unit controls the bias voltage in the at least one subfield to be 150 to 400 volts, wherein the bias voltage is applied to the sustain electrode during the first subfield of the first, second and third low gray level subfields.

11. The apparatus of claim 1, wherein the driving unit controls a bias voltage to be approximately a sustain voltage, wherein the bias voltage is applied to the sustain electrode in one of the first, second and third low gray level subfields.

12. The apparatus of claim 1, wherein the driving unit controls the second low gray level subfield to have a larger gray level weight value than the first low gray level subfield, wherein a bias voltage applied to the sustain electrode in the second low gray level subfield is larger than a bias voltage applied to the sustain electrode in the first low gray level subfield.

13. The apparatus of claim 1, wherein the driving unit controls a voltage difference between a bias voltage applied to the sustain electrode and a scan reference voltage applied to the scan electrode during the low gray level subfield having the lowest gray weight value to be larger than a voltage difference between a bias voltage applied to the sustain electrode and a scan reference voltage applied to the scan electrode during other subfields.

14. The apparatus of claim 13, wherein the driving unit controls the voltage difference between the bias voltage applied to the sustain electrode and the scan reference voltage applied to the scan electrode during the low gray level subfield having the lowest gray weight value to be approximately 1.5 times greater than a sustain voltage.

15. The apparatus of claim 13, wherein the driving unit controls the voltage difference between the bias voltage applied to the sustain electrode and the scan reference voltage applied to the scan electrode during the low gray level subfield having the lowest gray weight value to be more than 250 volts.

16. The apparatus of claim 1, wherein the driving unit controls the second low gray level subfield to have a larger gray level weight value than a gray level weight value of the first low gray level subfield, wherein a voltage difference between a bias voltage applied to the sustain electrode and a scan reference voltage applied to the scan electrode in the second low gray level subfield is larger than a voltage difference between a bias voltage applied to the sustain electrode and a scan reference voltage applied to the scan electrode in the first low gray level subfield.

17. The apparatus of claim 1, wherein the driving unit applies a self-erase prevention waveform after a data waveform is applied to the address electrode in the low gray level subfield and before an increasing waveform is applied in a reset period in a subsequent subfield.

18. The apparatus of claim 17, wherein the driving unit controls the self-erase prevention waveform to include a gradually increasing waveform applied to the scan electrode during one of an address period and a sustain period and a waveform of a predetermined positive voltage applied to the sustain electrode.

19. The apparatus of claim 17, wherein the driving unit applies a substantially same self-erase prevention waveform during each subfield of the frame.

20. The apparatus of claim 19, wherein the driving unit controls the predetermined positive voltage of the self-erase prevention waveform to be larger than the voltage of a preset voltage and to be smaller than a sustain voltage.

21. The apparatus of claim 20, wherein the preset voltage comprises a ground voltage.

22. The apparatus of claim 20, wherein the driving unit controls the positive voltage to be approximately half of the bias voltage applied to the sustain electrode in the at least one subfield.

23. The apparatus of claim 1, wherein the driving unit applies a plurality of reset waveforms to the scan electrode in each reset period in subsequent subfields later in time than the low gray level subfield having the lowest gray weight value.

24. The apparatus of claim 23, wherein the driving unit controls a number of the reset waveforms applied to the scan electrode in the reset period in the plurality of sub fields to be different in one or more subfields sequential to and later in time than the low gray level subfield-having the lowest gray weight value.

25. The apparatus of claim 23, wherein the driving unit controls a number of the reset waveforms applied to the scan electrode in the reset period to be the same in subfields sequential to and later in time than the low gray level subfield having the lowest gray weight value.

26. The apparatus of claim 23, wherein the another subfield is subsequent to the at least one subfield.

27. The apparatus of claim 26, wherein during the first reset period, the driving unit applies a waveform to the scan electrode that increases from a preset level and decreases from a peak of the waveform to the preset level while the driving unit applies a waveform sustaining a voltage of the preset level to the sustain electrode.

28. The apparatus of claim 27, wherein the preset level comprises a ground level.

29. The apparatus of claim 26, wherein during the second reset period, the driving unit applies a waveform to the scan electrode that increases from a preset level and decreases from a peak of the rising waveform to the preset level and then decreases while the driving unit applies a waveform sustaining a voltage of the preset level to the sustain electrode.

30. The apparatus of claim 29, wherein the preset level comprises a ground level.

31. The apparatus of claim 26, wherein the driving unit controls the reset period of the second subfield to include another inverting reset period for inverting a wall discharge and a third reset period subsequent to the second reset period.

32. The apparatus of claim 1, wherein the driving unit applies a waveform sustaining a predetermined positive voltage to the sustain electrode.

33. The apparatus of claim 32, wherein the positive voltage comprises a sustain voltage.

34. The apparatus of claim 1, wherein the driving unit provides a first scan reference voltage to the scan electrode in the low gray level subfield having the lowest gray weight value and provides a second scan reference voltage to the scan electrode in other subfields, the first scan reference voltage being smaller than the second scan reference voltage.

35. The apparatus of claim 1, wherein the driving unit provides a first negative scan waveform to the scan electrode in the low gray level subfield having the lowest gray weight value and provides a second scan reference voltage to the scan electrode in the other subfields, the first negative scan pulse being larger than the second negative scan pulse.

36. The apparatus of claim 1, wherein the driving unit controls a magnitude of a data waveform applied to the address electrode in the low gray level subfield having the lowest gray weight value to be larger than a magnitude of a data waveform applied to the address electrode in the other subfields.

37. A driving method of a plasma display panel having a scan electrode, a sustain electrode, and an address electrode formed to intersect with the scan electrode and the sustain electrode, the method comprising:

applying waveforms to each of the scan electrode, the sustain electrode and the address electrode, wherein a voltage difference between the scan electrode and the sustain electrode during an address period of at least one subfield of a frame is larger than a voltage difference between the scan electrode and the sustain electrode during the address period in another subfield of the frame, and wherein the another subfield is provided right after the at least one subfield in time, wherein the driving unit controls the at least one subfield so as to exclude a sustain period in the at least one subfield or to exclude a sustain waveform during any sustain period of the at least one subfield, and the another subfield so as to include a sustain waveform during a sustain period of the another subfield, and wherein the at least one subfield comprises a low gray level subfield having a lowest gray weight value among first, second and third low gray level subfields of the frame, and the at least one subfield and the another subfield is included in the same frame.

38. A plasma display apparatus, comprising:

a plasma display panel having a scan electrode, a sustain electrode and an address electrode; and a driving circuit to provide waveforms to each of the scan electrode, the sustain electrode and the address electrode, wherein the driving circuit provides the waveforms such that a voltage difference between the scan electrode and the address electrode in an address period of at least one subfield of a frame is greater than a voltage difference between the scan electrode and the address electrode in an address period of another subfield of the frame, and wherein the driving circuit applies, to the scan electrode, a first reset waveform during a first subfield of the frame and a plurality of reset waveforms during a second subfield of the frame, and wherein the another subfield is provided right after the at least one subfield in time, wherein the driving unit controls the at least one subfield so as to exclude a sustain period in the at least one subfield or to exclude a sustain waveform during any sustain period of the at least one subfield, and the another subfield so as to include a sustain waveform during a sustain period of the another subfield, and wherein the at least one subfield comprises a low gray level subfield having a lowest gray weight value among first, second and third low gray level subfields of the frame, and the at least one subfield and the another subfield is included in the same frame.

39. The apparatus of claim 38, wherein the another subfield is subsequent to the at least one subfield and the at least one subfield includes a sustain period during which no sustain pulse is applied.

40. The apparatus of claim 38, wherein the another subfield includes a sustain period.

41. A driving method of a plasma display panel having a scan electrode, a sustain electrode, and an address electrode formed to intersect with the scan electrode and the sustain electrode, the method comprising:

applying waveforms to each of the scan electrode, the sustain electrode and the address electrode, wherein a voltage difference between the scan electrode and the address electrode during an address period of at least one subfield of a frame is larger than a voltage difference between the scan electrode and the address electrode during an address period in another subfield of the frame, wherein the another subfield is provided right after the at least one subfield in time, wherein the driving unit controls the at least one subfield so as to exclude a sustain period in the at least one subfield or to exclude a sustain waveform during any sustain period of the at least one subfield, and the another subfield so as to include a sustain waveform during a sustain period of the another subfield, and wherein the at least one subfield comprises a low gray level subfield having a lowest gray weight value among first, second and third low gray level subfields of the frame, and the at least one subfield and the another subfield is included in the same frame.

* * * * *